US007206541B2

(12) United States Patent
Fukita et al.

(10) Patent No.: US 7,206,541 B2
(45) Date of Patent: Apr. 17, 2007

(54) IMAGE HEATING APPARATUS WITH NIP PORTION PRESSURE INCREASING DOWNSTREAM

(75) Inventors: Taku Fukita, Mishima (JP); Hideo Nanataki, Yokohama (JP); Tetsuya Sano, Shizuoka-ken (JP); Yozo Hotta, Mishima (JP); Kazuhisa Kemmochi, Mishima (JP); Makoto Fukatsu, Mishima (JP); Keisuke Abe, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/886,595

(22) Filed: Jul. 9, 2004

(65) Prior Publication Data

US 2005/0036809 A1 Feb. 17, 2005

(30) Foreign Application Priority Data

Jul. 11, 2003 (JP) ..... 2003/195772
Jun. 30, 2004 (JP) ..... 2004/193164

(51) Int. Cl.
*G03G 15/20* (2006.01)

(52) U.S. Cl. ..... 399/328

(58) Field of Classification Search ..... 399/328, 399/320; 219/216
See application file for complete search history.

(56) References Cited

U.S. PATENT DOCUMENTS 5,267,005 A 11/1993 Yamamoto et al. ..... 355/290
5,319,425 A 6/1994 Forlani ..... 355/285
5,331,385 A 7/1994 Ohtsuka et al. ..... 355/290
5,881,349 A 3/1999 Nanataki et al. ..... 399/328
5,920,757 A 7/1999 Izawa et al. ..... 399/329
5,940,655 A 8/1999 Sano et al. ..... 399/69
5,970,299 A 10/1999 Sano et al. ..... 399/330
5,999,788 A 12/1999 Kanesawa et al.
6,031,215 A 2/2000 Nanataki et al. ..... 219/619
6,049,691 A 4/2000 Abe et al. ..... 399/330
6,072,964 A 6/2000 Abe et al. ..... 399/69
6,075,228 A 6/2000 Goto et al. ..... 219/216
6,131,010 A 10/2000 Kume et al. ..... 399/333
6,246,843 B1 6/2001 Nanataki et al. ..... 399/45

(Continued)

FOREIGN PATENT DOCUMENTS

JP 4-242774 8/1992

(Continued)

OTHER PUBLICATIONS

Partial translation of cited JP 07-271217A.*

(Continued)

*Primary Examiner*—Quana Grainger
(74) *Attorney, Agent, or Firm*—Fitzpatrick, Cella, Harper & Scinto

(57) ABSTRACT

An image heating apparatus for heating an image formed on a recording material, includes a heating member; a flexible member movable in contact with the heating member; an elastic roller for forming a nip with the heating member with the flexible member interposed therebetween; wherein a pressure in the nip increases to a maximum peak toward downstream substantially without decreasing with respect to a moving direction of the recording material, wherein the heating member is disposed upstream of the maximum peak portion with respect to the moving direction of the recording material.

21 Claims, 24 Drawing Sheets

U.S. PATENT DOCUMENTS

| | | | | |
|---|---|---|---|---|
| 6,343,195 | B1 | 1/2002 | Abe et al. | 399/69 |
| 6,347,201 | B1 | 2/2002 | Sano et al. | 399/67 |
| 6,347,211 | B2 | 2/2002 | Nanataki et al. | 399/328 |
| 6,490,429 | B2 * | 12/2002 | Okayasu et al. | 399/328 |
| 6,654,571 | B2 | 11/2003 | Nanataki et al. | 399/69 |
| 2003/0058320 | A1 | 3/2003 | Sano et al. | 347/103 |
| 2004/0033092 | A1 * | 2/2004 | Aruga | 399/329 |
| 2004/0114975 | A1 | 6/2004 | Sano et al. | 399/328 |
| 2004/0136762 | A1 * | 7/2004 | Okayasu et al. | 399/329 |
| 2004/0184850 | A1 * | 9/2004 | Yoneda et al. | 399/329 |

FOREIGN PATENT DOCUMENTS

| | | |
|---|---|---|
| JP | 5-257402 | 10/1993 |
| JP | 6-230624 | 8/1994 |
| JP | 7-271217 | 10/1995 |
| JP | 10-48868 | 2/1998 |
| JP | 10-198200 | 7/1998 |
| JP | 11-133776 | 5/1999 |
| JP | 2001-324886 | 11/2001 |

OTHER PUBLICATIONS

Search Report/Official Letter dated Oct. 20, 2004 (Ref. No. EP 42403).

* cited by examiner

IMAGE HEATING APPARATUS WITH NIP PORTION PRESSURE INCREASING DOWNSTREAM

FIELD OF THE INVENTION AND RELATED ART

The present invention relates to an image heating apparatus for heating an image formed and borne on recording medium (ordinary paper, resin sheet such as OHP sheet, etc.). In particular, it relates to a thermal fixing apparatus as a preferable image heating apparatus to be mounted in an image forming apparatus capable of forming a full-color image with the use of toner.

In recent years, demand has been increasing, in the field of an image forming apparatus, for a full-color image forming apparatus such as a copying machine, a printer, etc., employing one of the electrophotographic recording technologies or electrostatic recording technologies and capable of outputting a highly glossy full-color image. When designing an image forming apparatus capable of outputting a highly glossy image, it is a common practice to rely on a fixing apparatus in order to control the level of glossiness at which an image is formed.

A fixing apparatus disclosed as a fixing apparatus capable of producing a highly glossy image in Japanese Laid-open Patent Application 11-133776 comprises a fixation roller, an endless belt, and a pressure pad. The fixation roller comprises a metallic core, and an elastic layer covering the peripheral surface of the metallic core. The pressure pad is kept pressed against the peripheral surface of the fixation roller, forming a nip, with the endless belt sandwiched between the fixation roller and pressure pad. FIG. 2 of this document shows a fixing apparatus equipped with a member for locally deforming the fixation roller in order to facilitate the separation of a recording medium. This member is located at the downstream edge, or exit, of the nip in terms of the recording medium conveyance direction.

However, in the case of a fixing apparatus structured as the one disclosed in Japanese Laid-open Patent Application 133776, the heat generated by a halogen heater is transmitted to the metallic core through a body of air. Therefore, it takes a substantial length of time to start up the fixing apparatus. In addition, its structural arrangement is such that the fixation roller is heated in its entirety. Therefore, the amount of the heat which radiates without contributing to fixation is substantial, being problematic from the standpoint of energy usage efficiency.

An unfixed image, that is, a layer of toner, contains a large number of pockets of air. Thus, the number of the pockets of air in an unfixed full-color image is several times that of an unfixed monochromatic image. Further, as an unfixed toner image containing a large number of pockets of air is heated, the pockets of air in the toner layer expand while the toner melts. As the pocket of air expand, they sometimes enter between the toner layer and recording medium, adversely affecting the fixation, and/or they break through the toner layer, leaving thereby a large number of minute holes, some of which extend from the outward surface of the image to the recording medium. Microscopically, these holes appear as minute bubbles; macroscopically, they make the surface of the image uneven, causing thereby the image to appear less glossy.

As for a method for preventing an image from appearing less glossy for the above described reason, it is effective to heat a toner layer while pressing the toner layer with a fixation roller in a manner of enveloping the toner layer by the elastic layer of the fixation roller, so that in the fixation station, the elastic layer of the fixation roller deforms in a manner to conform to the minute peaks and valleys of the surface of the toner layer (an unfixed image). With the elastic layer conforming to the peaks and valleys of the surface of an unfixed image, the toner layer is uniformly heated, being thereby uniformly melted, by the elastic layer. Moreover, as the elastic layer of the fixation roller rolls over the toner layer, it squeezes the pockets of air out of the toner layer. In other words, not only does the elastic layer prevent the pockets of air from reducing the level of glossiness at which an unfixed image is fixed, but also, elevates the level of uniformity at which an unfixed image is fixed. However, the thicker the elastic layer of the fixation roller of a fixing apparatus, the greater the elastic layer in thermal capacity, and therefore, the longer it takes to start up the fixing apparatus.

Japanese Laid-open Patent Application 10-198200 discloses two fixing apparatuses different from the one described above. One comprises an endless film, a piece of slippery plate solidly fixed within the loop of the endless film, in contact with the inward surface of the endless film, and a pressure roller kept pressed against the slippery plate, forming a nip, with the endless film sandwiched between the pressure roller and slippery plate. In operation, heat is generated in the endless film by electromagnetic induction. The other is similar in structure, except that the slippery plate also functions as a heater. In both fixing apparatuses, the slippery plate is provided with a rib so that the internal pressure of the nip is locally increased to elevate the level of glossiness at which an image is formed.

In the case of the first structural arrangement disclosed in this patent application, heat is generated only across a part of the rotational member (endless film) itself, in terms of the circumferential direction thereof (in the case of the second structural arrangement, the nip is formed by the heater). Therefore, it is extremely efficient in energy usage, and is shorter in startup time. In addition, the internal pressure of the fixation nip is only locally increased, enabling thereby the fixation nip to squeeze out the pockets of air.

It was discovered, however, that the employment of these structural arrangements, that is, locally increasing the internal pressure of the fixation nip, causes the phenomenon that an image nonuniform in glossiness in terms of the direction perpendicular to the direction in which a recording medium is conveyed is outputted. It was also discovered that the phenomenon occurred for the following reason. That is, referring to FIG. 21(*b*), in the case of the structural arrangements disclosed in Japanese Laid-open Patent Application 10-198200, the internal pressure of the area P of the fixation nip, that is, the area immediately next to the downstream edge of the rib of the aforementioned slippery plate, in terms of the recording medium conveyance direction, is substantially lower than the maximum internal pressure of the fixation nip. The presence of this area P, or the low pressure area, allows the contact between the rotational member in the form of an endless film and the toner layer to become nonuniform in terms of the lengthwise direction of the slippery plate. As a result, the fixing apparatus becomes nonuniform, in terms of the lengthwise direction of the rib (direction perpendicular to recording medium conveyance direction), in terms of the ability to squeeze out the pockets of air. Consequently, an image nonuniform in glossiness in terms of the lengthwise direction of the rib of the slippery plate is outputted.

FIG. 16 depicts the state of the fixation nip, in which the fixation pressure is nonuniform, that is, the contact between the circularly movable member in the form of an endless film and the toner layer is nonuniform, in terms of the lengthwise direction of the nip. FIGS. 22 and 23 depict how the toner layer melts when the pressure which applies to the toner image during the fixation is insufficient. Incidentally, FIG. 22 does not show the heater, nor the circularly rotatable member in the form of an endless film.

Referring to FIGS. 22 and 23, if the area, in which the amount of the pressure which applies to the toner image during fixation is insufficient, is present in the fixation nip of a fixing apparatus, the level of glossiness at which an image is fixed by the fixing apparatus falls for the following reason. That is, even if higher pressure is applied to the toner image after the toner image is moved past the low pressure area, the toner will have not been thoroughly melted by the time the higher pressure is applied. Therefore, as the toner melts after being moved past the low pressure area, the pockets of air in the toner layer escapes form the toner layer, leaving holes in the surface of the toner layer. The presence of these holes lowers the level of the flatness of the surface of the toner layer, lowering thereby the level of glossiness of the surface of the toner layer (toner image).

SUMMARY OF THE INVENTION

The present invention was made in consideration of the above described problems, and its primary object is to provide an image heating apparatus which is not only capable of outputting an image higher in glossiness and uniform in appearance, but also, superior in energy usage efficiency, compared to an image heating apparatus in accordance with the prior art.

According to an aspect of the present invention, there is provided an image heating apparatus for heating an image formed on a recording material, comprising: a heating member; a flexible member movable in contact with said heating member; an elastic roller for forming a nip with said heating member with said flexible member interposed therebetween; wherein a pressure in the nip increases to a maximum peak toward downstream substantially without decreasing with respect to a moving direction of the recording material, wherein said heating member is disposed upstream of the maximum peak portion with respect to the moving direction of the recording material.

According to another aspect of the present invention, there is provided an image heating apparatus for heating an image formed on a recording material, comprising: a heating member; a flexible member movable in contact with said heating member; an elastic roller for forming a nip with said heating member with said flexible member interposed therebetween; wherein a downstream end of said heating member with respect to the moving direction enters into said elastic roller more than the upstream end, and said heating member is disposed upstream of a maximum peak portion of a pressure in the nip with respect to the moving direction.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 6-1 is a schematic drawing depicting the pressure distribution of the fixation nip (No. 1).

FIG. 6-2 is a schematic drawing depicting the pressure distribution of the fixation nip (No. 2).

FIG. 6-3 is a schematic drawing depicting the pressure distribution of the fixation nip (No. 3).

FIG. 19(*b*) is a schematic sectional view of the fixing apparatus in the second embodiment of the present invention, showing the structure thereof (No. 2).

FIG. 19(*c*) is a schematic sectional view of the fixing apparatus in the second embodiment of the present invention, showing the structure thereof (No. 3)

DETAILED DESCRIPTION OF THE PREFERRED EMBODIMENTS

Embodiment 1

(1) Image Forming Apparatus Example

Figure 1:
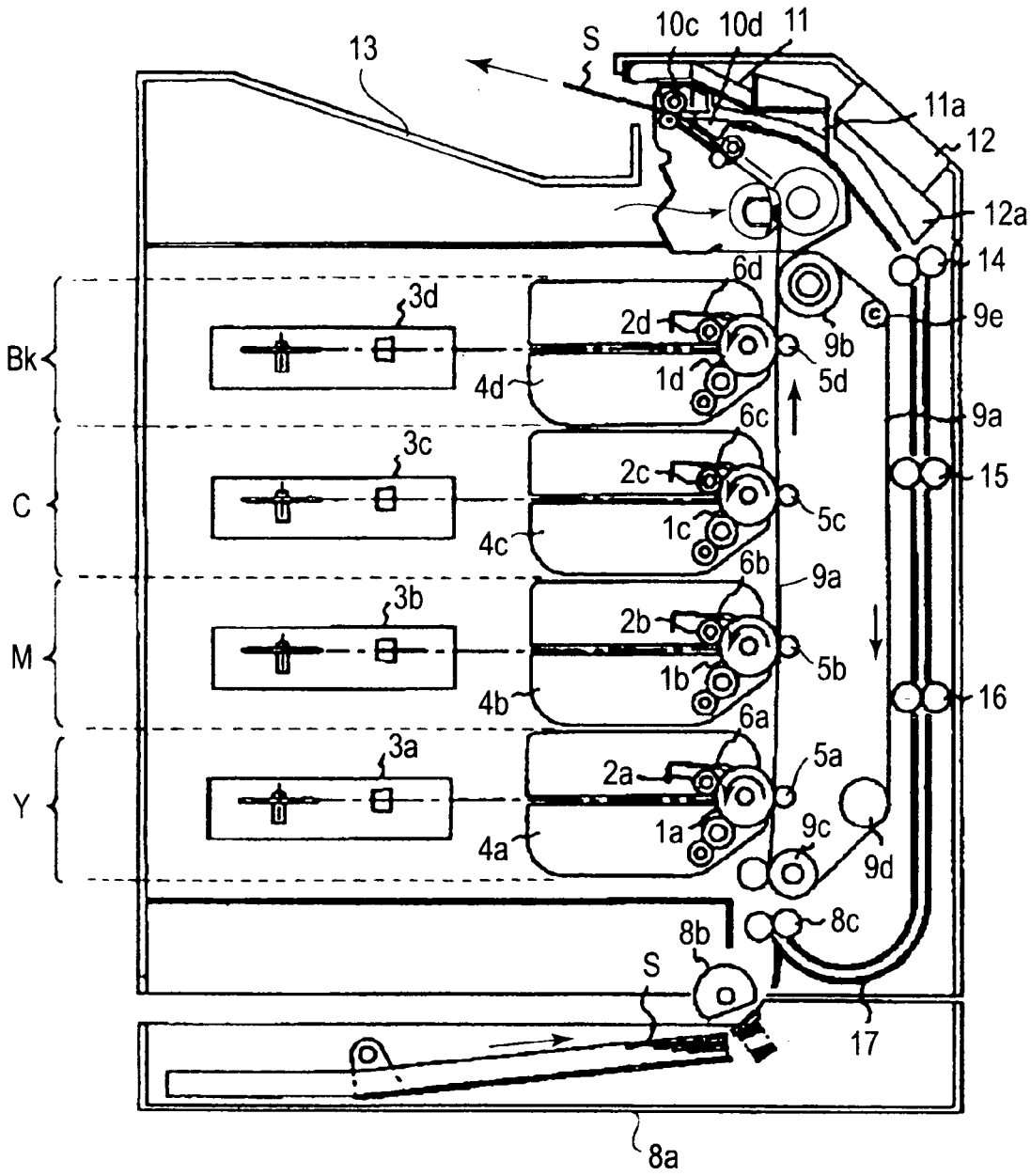
FIG. 1 is a schematic sectional view of the image forming apparatus in the first embodiment of the present invention, showing the general structure thereof.

FIG. 1 is a schematic sectional view of a typical image forming apparatus comprising an image heating apparatus, as a fixing apparatus, in accordance with the present invention, showing the general structure thereof. The image forming apparatus in this embodiment is a color laser beam printer of a tandem type employing one of the electrophotographic processes.

Designated by referential characters Y, M, C, and Bk are four image formation stations (first to fourth stations) which form toner images corresponding in color to the yellow, magenta, cyan, and black color components of an intended image, respectively, and which are vertically stacked in parallel in the listed order counting from the bottom.

The first to fourth image formation stations Y, M, C, and Bk comprise electrophotographic photosensitive members (which hereinafter will be referred to simply as photosensitive drum) 1*a*, 1*b*, 1*c*, and 1*d*, as latent image bearing members, which are rotated at a predetermined process speed in the direction indicated by arrow marks in the drawing (counterclockwise direction), primary charging means 2*a*, 2*b*, 2*c*, and 2*d*, laser beam based exposing means (which hereinafter will be referred to as scanner) 3*a*, 3*b*, 3*c*, and 3*d*, developing portions 4*a*, 4*b*, 4*c*, and 4*d*, cleaning means 6*a*, 6*b*, 6*c*, and 6*d*, etc., respectively.

Designated by a referential symbol 9*a* is an endless conveying belt as a member for conveying a recording medium while electrostatically holding it. The endless electrostatic adhesion conveying belt 9*a* is located on the photosensitive drum side (front side of printer) of the set of the vertically stacked first to fourth image formation stations Y, M, C, and Bk, being vertically extended from the first to the fourth image forming stations. Referential symbols 9*b*, 9*c*, 9*d*, and 9*e* designate rollers around which the electrostatic adhesion conveying belt 9*a* is stretched and suspended. The roller 9*a* is a driver roller, and rollers 9*c* and 9*d* are support rollers. The roller 9*d* is a tension roller. The electrostatic adhesion conveying belt 9*a* is circularly driven by the driver roller 9*b* in the direction indicated by an arrow mark in the drawing (clockwise direction) at a peripheral velocity matching the peripheral velocities of the photosensitive drums 1*a*–1*d*.

Designated by referential symbols 5*a*, 5*b*, 5*c*, and 5*d* are four transfer rollers (first to fourth), which are kept pressed against the photosensitive drums 1*a*–1*d* of the first to fourth image formation stations Y, M, C, and Bk, with the electrostatic adhesion conveying belt 9*a* sandwiched between the transfer rollers 5*a*, 5*b*, 5*c*, and 5*d* and photosensitive drums 1*a*–1*d*, respectively.

In the first to fourth image forming stations Y, M, C, and Bk, the photosensitive drums 1*a*–1*d* are rotationally driven. These photosensitive drums are rotationally driven by an unshown drum motor (DC servo motor). However, each photosensitive drum may be provided with its own driving force source. The rotation of the drum motor is controlled by an unshown DSP (digital signal processor), whereas the other controls are executed by an unshown CPU.

In the first to fourth image formation stations Y, M, C, and Bk, the photosensitive drums 1*a*–1*d* are uniformly charged to predetermined polarity and potential level by the primary charging means 2*a*–2*d*, respectively, as they are rotated. Then, the charged peripheral surfaces of the photosensitive drums 1*a*–1*d* are exposed to four optical images, one for one, by scanners 3*a*–3*d*, respectively. As a result, an electrostatic latent image is formed on each of the photosensitive drums 1*a*–1*d*. The electrostatic latent images on the photosensitive drums 1*a*–1*d* are developed by the development stations 4*a*–4*d* into images formed of yellow, magenta, cyan, and black toners, which correspond in color to the four color components into which an intended full-color image has been separated by the electrophotographic process (hereinafter, images formed of toner will be referred to simply as toner images). As a result, yellow, magenta, cyan, and black toner images are formed on the photosensitive drums 1*a*–1*d*, respectively.

Meanwhile, multiple pieces of recording medium S (transfer sheet) stored in a sheet feeder cassette 8*a* located in the bottom portion of the main assembly of the image forming apparatus are sequentially fed, while being separated, into the main assembly, by a sheet feeder roller 8*b*, in accordance with a predetermined image formation sequence control timing, and are conveyed to a pair of registration rollers 8*c*, which keep the recording mediums S on standby or allow them to be further conveyed to the electrostatic adhesion conveying member 9*a*, from the bottom side of the conveying member 9*a*, in synchronism with the progression of the image forming operation. As each of the recording mediums S is delivered to the electrostatic adhesion conveying belt 9*a*, it is electrostatically adhered to the surface of the electrostatic adhesion conveying belt 9*a*, being thereby securely held thereto, and is conveyed upward as the belt 9*a* is circularly driven. As the recording medium S is conveyed upward, yellow, magenta, cyan, and black toner images formed on the peripheral surfaces of the photosensitive drums 1*a*–1*d* in the first and fourth image formation stations Y, M, C, and Bk are transferred in layers onto the recording medium S in the first and fourth transfer stations, that is, the contact areas between the photosensitive drums 1*a*–1*d* and the electrostatic adhesion conveying belt 9*a*, respectively. As a result, a single unfixed full-color toner image is synthetically formed.

After the transfers of the toner images onto the recording medium S in the first to fourth image formation stations Y, M, C, and Bk, the residues such as the toner remaining adhered to the peripheral surfaces of the photosensitive drums 1*a*–1*d* are removed by the cleaning means 6*a*–6*d*, and then, the photosensitive drums 1*a*–1*d* are used for the following image formation cycle.

After being conveyed to the top end of the electrostatic adhesion conveying belt 9*a* while the toner images are transferred in layers from the four photosensitive drums 1*a*–1*d* onto the recording medium S, the recording medium S is separated from the surface of the conveying belt 9*a*, at the location of the driving roller 9*a*, and is further conveyed to a fixing apparatus 10 (fixing device), in which the toner images are thermally fixed. Thereafter, the recording medium S is discharged by a pair of discharge rollers 10 into a delivery tray 13.

The above described is the image forming operation of the image forming apparatus in the one-sided print mode. When the image forming apparatus is in the two-sided print mode, its operation is as follows. After the separation of the recording medium S, on one surface of which an image has been transferred, it is incompletely discharged by the pair of discharge rollers 10*c*, that is, the recording medium S is partially moved out of the apparatus main assembly, up to a point at which the trailing end of the recording medium S will have moved past the two-side print mode sheet guide 10*d*. Then, the pair of discharge rollers 10*c* are rotated in reverse to guide the recording medium S into the two-sided print mode sheet guide 10*d*. More specifically, as the pair of discharge rollers 10*c* are rotated in reverse, the recording medium S is moved into the sheet guide 10*d*, with the former trailing end becoming the leading end, and is guided by the top side of the guide 10*d*. Then, the recording medium S is guided to a pair of two-sided print mode rollers 14 by a guide rib 11*a* located under an air duct 11, and a guide rib 12*a* located under the control panel 12. Then, it is conveyed downward by the pair of rollers 14 to a pair of two-sided printer mode rollers 15, is conveyed further downward by the pair of rollers 15 to a pair of two-sided print mode rollers 16, is conveyed further by the pair of rollers 16 to the pair of registration rollers 8*a* along the U-turn guide 17. Then, it is released by the pair of registration rollers 8*c* to be delivered to the transfer nips between the photosensitive drums 1*a*–1*d* and electrostatic adhesion conveying belt 9*a*, in synchronism with the progression of the image forming operation in the two-sided print mode. The sequence thereafter is exactly the same as that in the one-sided print mode.

(2) Fixing Apparatus 10

Figure 2:
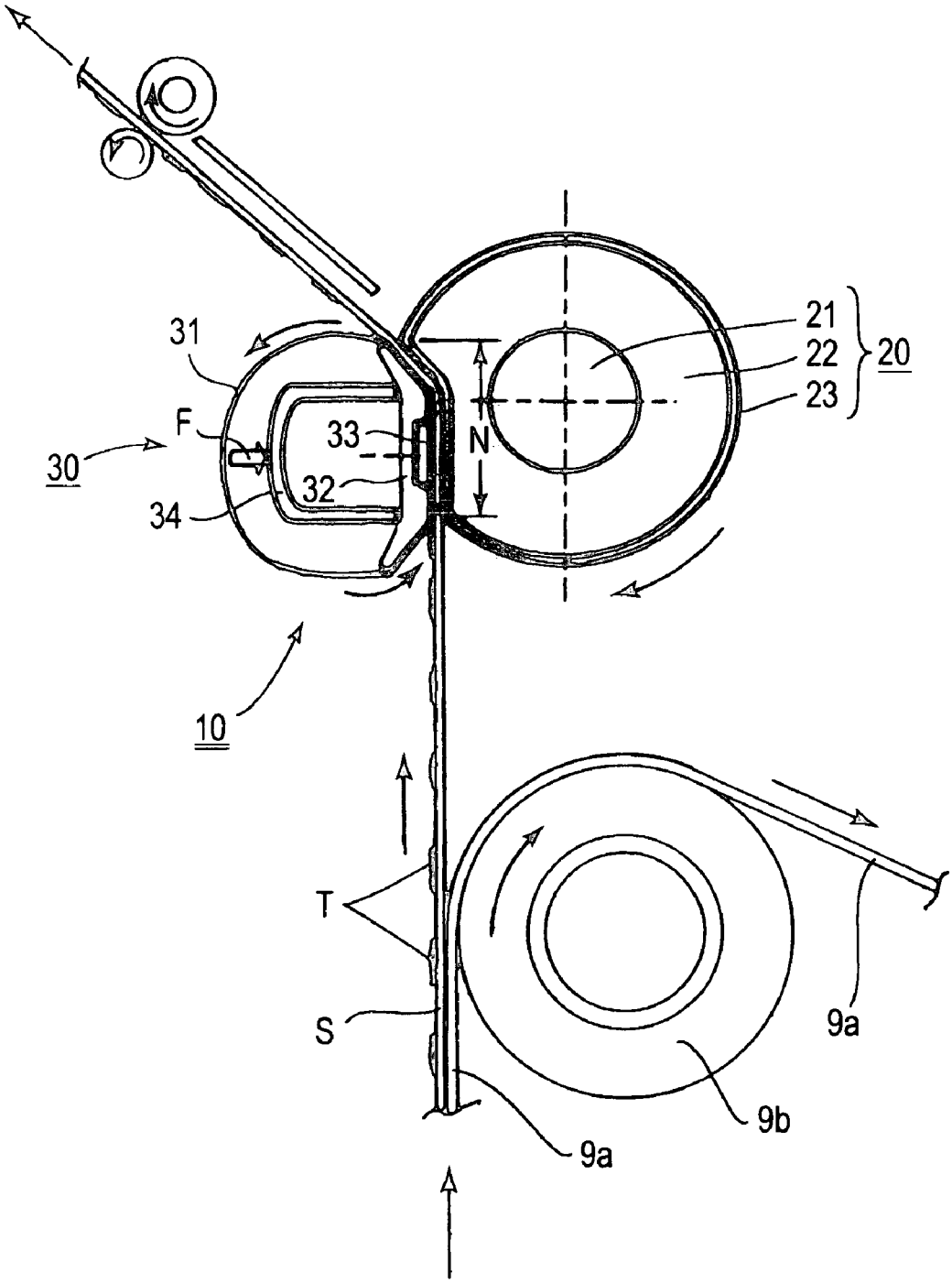
FIG. 2 is an enlarged schematic sectional view of the fixing apparatus in the first embodiment of the present invention.

FIG. 2 is an enlarged schematic sectional view of the essential portion of the fixing apparatus 10. This fixing apparatus 10 is a heating apparatus of a film heating and pressure roller driving type (tensionless). It employs a cylindrical fixation film (fixation film in the form of an endless belt), that is, a flexible member.

Designated by a referential number 30 is a heating unit comprising the circularly rotatable heating member, and designated by a referential number 20 is a pressure roller, which is an elastic roller. The two are kept pressed against each other, forming a fixation nip N.

1) Pressure Roller

The pressure roller 20 comprises: a metallic core 21 formed of aluminum or iron; an elastic layer 22 covering the peripheral surface of the metallic core 21; and a mold release layer 23 covering the peripheral surface of the elastic layer 22. It is rotatably supported between and by an unshown pair of lateral plates of the apparatus main frame, at the lengthwise end portions of the metallic core 21, with the interposition of a pair of bearings. It is rotationally driven by an unshown driving system at a predetermined velocity in the direction indicated by an arrow mark in the drawing (clockwise direction).

The elastic layer 22 is formed of solid silicon rubber, sponge rubber made by foaming the silicon rubber to make the silicon rubber thermally insulative, foamed rubber made by dispersing hollow filler particles in the silicon rubber to make the silicon rubber thermally insulative, or the like.

The mold release layer 23 may be formed by coating the peripheral surface of the elastic layer 22 with fluorinated resin, such as perfluoroalkoxyl resin (PFA), polytetrafluoroethylene resin (PTFE), and tetrafluoroethylene-hexafluoropropylene resin (FEP), or GLS latex (registered commercial name: Daikin Co., Ltd.). It may be in the form of a tube fitted over the elastic layer 22. It may be formed by coating the peripheral surface of the elastic layer 22 with mold releasing paint.

2) Heating Unit 30

The heating unit 30 comprises a heating member holder 32, a heating member 33, a rigid pressure application stay 34, a fixation film 31 (flexible sleeve), etc. The heating member holder 32 extends in the direction perpendicular to the drawing (direction intersectional to recording medium conveyance direction) which is heat resistant, thermally insulative, and rigid. The heating member 33 is firmly attached to the holder 32 by being fitted in the groove of the holder 32 cut in the outwardly facing surface of the holder 32 in the lengthwise direction of the holder 32. The rigid stay 34 is U-shaped in cross section, and is formed of a metallic substance. It is placed on the inward side of the holder 32 to support the holder 32. The fixation film 31 is loosely fitted around the assembly of the heating member holder 32, heating member 33, and rigid stay 34.

In the case of the fixing apparatus 10 in this embodiment, the lengthwise ends of the metallic core 21 of the pressure roller 20 are rotatably supported by the pair of lateral plates of the apparatus main assembly frame, with the interposition of the pair of bearings, so that the pressure roller 20 is rotatably supported between the pair of lateral plates. The heating unit 30 is placed on the left side, in FIG. 2, of the pressure roller 20, in parallel to the pressure roller 20, so that the heating member 33 of the heating unit 30 faces the pressure roller 20. The lengthwise end portions of the rigid pressure application stay 34 are kept pressured toward the pressure roller 2 by an unshown pressure applying means, such as a pair of springs, so that the rigid pressure application stay 34 is kept pressured against the elastic layer 22 of the pressure roller 20 by a predetermined amount of pressure F. As a result, the elastic layer 22 of the pressure roller 20 is kept compressed, on the left-hand side thereof, by a predetermined thickness in the radius direction of the pressure roller 20 by the combination of the heating member 33 and heating member holder 32, with the fixation film 31 remaining pinched between the combination of the heating member 33 and heating member holder 32, and the pressure roller 22, forming thereby the fixation nip N.

As the pressure roller 20 is rotationally driven, the torque from the rotational driving of the pressure roller 20 is transmitted to the cylindrical fixation film 31. As a result, the fixation film 31 is rotated around the assembly of the heating member holder 32, heating member 33, and rigid pressure application stay 34, in the direction indicated by an arrow mark in the drawing (clockwise direction), with the fixation film 31 sliding on the heating member holder 32 and heating member 33 in such a manner that the inward surface of the fixation film 31 remains perfectly in contact with the outwardly facing surfaces of the heating member holder 32 and heating member 33.

As the pressure roller 20 is rotationally driven, and the cylindrical fixation film 31 is rotationally driven by the pressure roller 20, power is supplied to the heating member 33 to raise the temperature of the heating member 33 to a predetermined temperature level, and maintain it at the predetermined temperature level. As the temperature of the heating member 33 is maintained at the predetermined temperature level, the recording medium S bearing an unfixed toner image T is introduced info the fixation nip N, that is, the interface between the heating unit 30 (fixation film 31) and pressure roller 20, and is conveyed through the fixation nip N, with the recording medium S pinched between the fixation film 31 and pressure roller 20 so that the toner image bearing surface of the recording medium S is kept perfectly in contact with the outwardly facing surface of the fixation film 31. While the recording medium S is conveyed through the fixation nip N as described above, the heat from the heating member 33 is given to the recording medium S through the fixation film 31. As a result, the unfixed toner image T on the recording medium S is welded (fixed) to the recording medium S by heat and pressure. After being conveyed through the fixation nip N, the recording medium S becomes separated from the fixation film 31 due to the curvature of the cylindrical fixation film 31.

The fixation film 31 (flexible member) comprises a substrate layer formed of heat resistant and heat insulating film of resin, such as polyamide, polyamide-imide, PEEK, PES, PPS, PFA, PTFE, FEP, etc., and a surface layer formed of a single or mixture of heat resistant resins, such as PFA, PTFE, FEP, silicone resin, etc., superior in mold releasing properties.

The heating member holder 32 is formed of resin such as liquid polymer, phenol resin, PPS, PEEK, etc., which are heat resistant and slippery.

Figure 3:
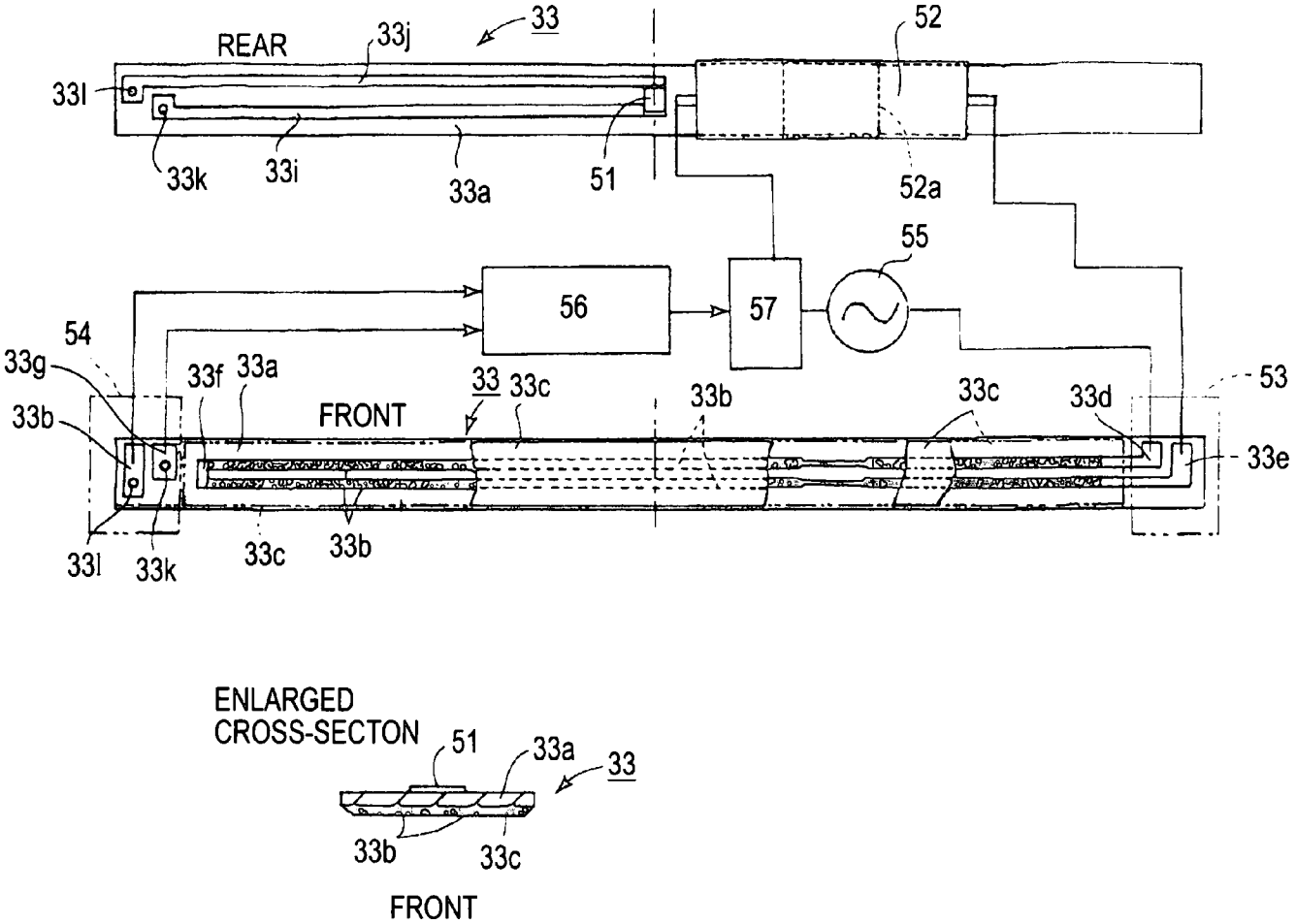
FIG. 3 is a schematic drawing showing the structure of the heater.

FIG. 3 is a schematic drawing of the heating member 33 in this embodiment, showing the structure thereof. This heating member 33 is a low heat capacity ceramic heater, which generates heat at its top surface. It basically comprises a substrate, a heat generating resistive layer, a dielectric layer, and power supply electrodes. The substrate is formed of dielectric ceramics such as alumina or aluminum nitride, or heat resistant resin such as polyimide, PPS or liquid polymer. The heat generating resistive layer is a line or narrow strip of Ag/Pd, $RuO_2$, $Ta_2N$, etc., formed on the surface of the substrate. It generates heat as electric current is flowed through it. It is coated on the surface of the substrate with the use of such a means as screen printing, and baked. The dielectric layer is a layer of glass or the like coated over the combination of the substrate and heat generating resistive layer. The power supply electrodes are electrically connected to the heat generating resistive layer, and voltage is applied to the power supply electrodes from a power supply circuit through a power supply connector.

More specifically, the heating member 33 comprises:

1. substrate 33*a* which is a piece of thin, narrow, and flat plate of $Al_2O_3$, AIN, or the like, and extends in the direction parallel to the direction intersectional (perpendicular) to the direction in which a recording medium S is conveyed through the fixation nip N;

2. two parallel strips of heat generating resistive layer 33*b*, which are roughly 10 μm thick and 1–5 mm wide, extending in the direction parallel to the lengthwise direction of the substrate 33*b*, are formed on the top surface of the substrate 33*a*, of electrically resistive substance such as Ag/Pd, with the use of a method in which the electrically resistive substance is coated in a predetermined pattern on the substrate 33*b* by screen printing or the like, and is baked;

3. first and second power supply electrodes 33*d* and 33*e* formed on the substrate, being electrically connected to the two parallel strips of heat generating layer 33*b*, one for one, at one of the lengthwise ends of the substrate 33*a;*

4. electrically conductive portion 33*f* formed, by patterning, on the substrate 33*a* to electrically connect in series the two parallel strips of heat generating resistive layer 33*b*, at the other lengthwise end of the substrate 33*a;*

5. first and second temperature control output electrodes 33*g* and 33*h* formed on the substrate 33*a* by patterning, being located outward side of the electrically conductive portion 33*f* in terms of the lengthwise direction of the substrate 33*a;*

6. a thin (roughly 10 μm thick) protective layer 33*c* formed on the substrate 33*a*, by patterning, in a manner to cover the combination of the heat generating resistive layer and electrically conductive portion 33*f*, along with the surface of the substrate 33*a;*

7. a temperature detection element 51, such as a thermistor, placed on the back (rear) side of the substrate 33*a*, in contact with the center portion, in terms of the lengthwise direction of the substrate 33*a*, of the rear (back) surface of the substrate 33*a;*

8. first and second electrically conductive portions 33*i* and 33*j* formed on the back (rear) surface of the substrate 33*a* by patterning, being electrically connected to the temperature detection element 51;

9. through holes 33*k* and 33*l* formed through the substrate 33*a* so that the first and second electrically conductive portions 33*i* and 33*j* on the back (rear) surface of the substrate 33*a* can be electrically connected to the first and second temperature control output electrodes 33*g* and 33*h*, respectively, on the outward surface of the substrate 33*a;*

10. etc.

This heating member 33 is firmly embedded, in a manner of being inlayed, in the groove formed in the outward surface of the heating member holder 32 so that the top surface of the heating member 33 (top surface of substrate 33*a* which bears heat generating resistive layer 33*b* and protective glass layer 33*c*) faces outward to be placed in contact with the inward surface of the fixation film 31.

Designated by a referential number 52 is a thermo-protector such as a thermal fuse, thermo-switch, or the like, which is placed on the back (rear) side of the substrate 33*a*, with its heat collector plate 52*a* placed in contact with a predetermined portion of the back surface of the heating member 33.

Designated by a referential number 52 is a power supply connector, which is attached to one of the lengthwise end portions of the substrate 33*a* having the first and second power supply electrodes 33*d* and 33*e* of the heating member 33 firmly held to the heating member holder 32, electrically connecting the power supply electrodes 33*d* and 33*e* to the electrical contacts of the power supply connector 53.

Designated by a referential number 54 is a temperature control connector, which is attached to the other lengthwise end of the heating member 33 having the first and second temperature control output electrodes 33*g* and 33*h*, electrically connecting the temperature control output electrodes 33*g* and 33*h* to the electrical contacts of the temperature control connector 54.

Referential numbers 55, 56, and 57 designate an AC power source, a control circuit (CPU), and a TRIAC (triode AC switch). The heating member 33 is supplied with electric power by the AC power source 55 through the power supply connector 53, first and second power supply electrodes 33*d* and 33*e*; more specifically, power is supplied to the heat generating resistive layer 33*b*. As a result, heat is generated across the entirety of the heat generating resistive layer 33*b*, very quickly raising the temperature of the heating member 33. The temperature increase of the heating member 33 is detected by the temperature detection element 51, and the information, in the form of electrical signal, regarding the detected temperature is inputted into the control circuit 56 through the first and second electrically conductive portions 33*i* and 33*j*, electrically conductive walls of the through holes 33*k* and 33*l*, first and second temperature control output electrodes 33*g* and 33*h*, and temperature control connector 54. The control circuit 56 controls the TRIAC 57 in response to the inputted information regarding the detected temperature of the heating member 33; it keeps the temperature of the heating member 33 at a predetermined fixation temperature by controlling the phase, wave count, etc., of the electric power supplied to the heat generating layer 33*b* of the heating member from the AC power source 55.

The thermo-protector 52 located on the back side of the heating member 33, with its heat collector plate 52*a* kept in contact with the back side of the heating member 33, is serially inserted in the circuit for supplying electric power to the heat generating resistive layer 33*b* of the heating member 33. Thus, if the heating member 33 overheats, that is, the temperature of the heating member 33 exceeds the allowable level, because the power supply to the heat generating resistive layer 33*b* of the heating member 33 from the power source 55 become uncontrollable, and therefore, the heat generating layer is continuously supplied with power, because of some problem occurring to the control circuit 56, TRIAC 57, etc., the thermo-protector is melted by the heat from the heating member 33, breaking thereby the power supply circuit, and therefore, forcefully shutting down the power supply to the heat generating resistive layer 33*b* for safety.

The structural arrangement for controlling the temperature of the heating member 33 does not need to be limited to the above described one. For example, it may be such that the temperature level at which the surface temperature of the fixation film 31 needs to be for fixing the toner image T on the recording medium S, in the fixation nip N, is set as the target temperature for the surface of the fixation film 31, and the amount by which electric power is supplied to the heat generating resistive layer 33*b* of the heating member 33 is controlled according to the surface temperature level of the fixation film 31 detected by the unshown temperature detecting means such as a thermistor disposed so that it remains in contact with the inward surface of the fixation film 31, at an optional point within the range of the fixation nip N, in order to keep the surface temperature of the fixation film 31 at the target temperature.

The substrate of the heating member 33 is formed of dielectric ceramic such as alumina or aluminum nitride, heat resistant resin such as polyimide, PPS, or liquid polymer, or the like. Therefore, the heating member 33 can be simplified in shape; for example, it can be made thin and flat.

3) Detailed Description of Fixation Nip N

Figure 4:
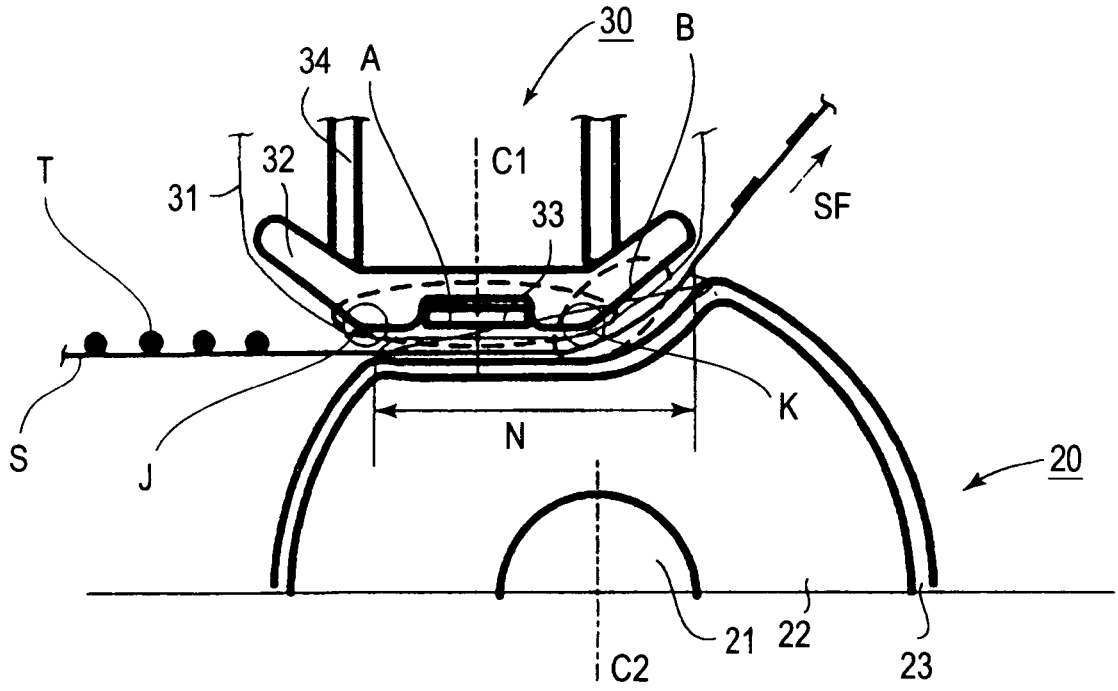
FIG. 4 is an enlarged schematic sectional view of the fixation nip.

FIG. 4 is a schematic sectional view of the fixation nip N of the fixing apparatus 10 in this embodiment, depicting the structure thereof. Incidentally, in FIG. 2, the fixation nip N of the fixing apparatus is oriented so that a recording medium S is vertically fed into the fixation nip N. In FIG. 4, however, for ease of description, the fixation nip N is oriented so that the recording medium S is horizontally fed into the fixation nip N.

The gist of the present invention is as follows. A fixing apparatus is structured so that as the recording medium S is conveyed through the fixation nip N, the amount of the pressure which applies to a given point of the recording member S reaches its peak with virtually no decline between the recording medium entrance (upstream end in terms of recording medium conveyance direction) of the fixation nip N and the peak pressure point in the fixation nip N, that is, the point at which the amount of pressure which applies to the recording medium S is highest in the fixation nip N. Further, the heating member is located on the upstream side of the peak pressure point of the fixation nip N, in terms of the recording medium conveyance direction. Looking at the fixation nip N and its adjacencies in this embodiment from the direction parallel to the lengthwise direction of the fixation nip N, the line C1, which is perpendicular to the flat portion A of the recording medium pressing portion of the fixation film guiding (contacting) slippery surface of the heating unit 30, made up of the outwardly facing surfaces of the heating member 33 in the form of a piece of thin plate (which hereinafter may be referred to as heating plate 33) and heating member holder 32, and which coincides with the center of the portion A, in terms of the recording medium conveyance direction, is on the upstream side of the line C2 (hypothetical line parallel to line C1), which coincides with the rotational axis of the pressure roller; it is on the recording medium entrance side of the line C2. In other words, the heating member, heating member holder, and pressure roller are positioned so that the hypothetical line, which is perpendicular to the surface of the heating member, which is in contact with the fixation film, and coincides with the center of the heating member in terms of the recording medium conveyance direction, is on the upstream side of the rotational axis of the pressure roller in terms of the recording medium conveyance direction. With the employment of this structural arrangement, the upstream end J of the flat portion A of the fixation film guiding slippery surface of the heating unit, made up of the outward surface of the heating plate 33 and the outward surface of the heating member holder 32 is on the upstream side of the recording medium entrance of the fixation nip N, and the downstream end K of the flat portion A of the fixation film guiding slippery surface of the heating unit 30, made up of the outward surface of the heating plate 33 is within the fixation nip N. The heating unit 30 is kept pressed against the pressure roller 20, with the fixation film 31 pinched between the heating unit 30 and pressure roller 20. Further, as described above, the fixation film 31 pinched by the pressure roller 20 and the combination of the heating member holder 32 and heating plate 33 is circularly moved around the combination of the heating member holder 32 and rigid pressure application stay 34 by the rotation of the pressure roller 20.

Also with the employment of the above described structural arrangement, the portion B is created, as a part of the fixation nip N, which extends from the downstream end K of the recording medium pressing flat portion A to the recording medium ext of the fixation nip N, and in which the internal pressure of the fixation nip N sharply reduces toward the recording medium exit.

As described above, in the sectional view of the fixing apparatus in this embodiment, perpendicular to the rotational axis of the heating unit 30, the line C1 perpendicular to the aforementioned flat portion A and coinciding with the center of the flat portion A in terms of the recording medium conveyance direction SF, is on the upstream side, in terms of the recording medium conveyance direction SF, that is, on the recording medium entrance side, of the line C2 perpendicular to the flat portion A and coinciding with the rotational axis of the pressure roller 20. Further, the upstream end J of the recording medium pressing slippery surface made up of the outwardly facing surfaces of the heating plate 33 and heating plate holding member 32 is outside the recording medium entrance of the fixation nip N. With the provision of this structural arrangement, the pressure distribution within the fixation nip N becomes such that the closer to the downstream end K of the portion A of the recording medium guiding (pressing) surface of the heating unit 30, the higher the amount of pressure which applies to the recording medium S as the recording medium S is conveyed through the fixation nip N while being heated by the heating plate 33.

At this time, the various phenomena which occur in the fixation nip N in this embodiment will be described.

First, referring to FIG. 5(*b*), the pressure distribution in the fixation nip N will be described. As will be evident from FIG. 5(*b*), the pressure distribution in the fixation nip N in this embodiment is such that as the recording medium S is conveyed through the fixation nip N, the amount of the pressure which applies to the recording medium S begins to increase shortly after the recording medium S is moved into the fixation nip N, and continuously increases to its peak with virtually no decrease. Then, as the recording medium S is moved past the peak pressure point K in the fixation nip N, the pressure which applies to the recording medium S begins to decrease, and steeply decreases to virtually zero by the time the recording medium S reaches the recording medium exit of the fixation nip N. In order to realize this pressure distribution, the fixing apparatus in this embodiment is structured to position its heating member, heating member holder, and pressure roller so that the upstream end J of the portion A of the recording medium pressing surface of the heating unit 30 is on the upstream of the recording medium entrance of the fixation nip N (outside fixation nip N), and the hypothetical line (C1 in FIG. 4) perpendicular to the flat surface of the heating member substrate which contacts the fixation film, and coinciding with the center of the flat surface in terms of the recording medium conveyance direction, is on the upstream of the rotational axis of the pressure roller, in terms of the recording medium conveyance direction. To describe in more detail, the upstream end J of the portion A of the recording medium pressing surface of the heating unit is located on the upstream of the recording medium entrance of the fixation nip N (outside fixation nip), and the downstream end K roughly coincides with the intersection of the hypothetical plane H connecting the upstream and downstream ends J and K of the portion A of the recording medium pressing surface of the heating unit, and the hypothetical plane V perpendicular to the hypothetical plane H and coinciding with the rotational axis of the pressure roller 20 (distance from hypothetical plane V to downstream end K is virtually zero), as shown in FIG. 6-1. With the provision of the above described positional arrangement, the amount of the invasion of the portion A of the recording medium pressing surface of the heating unit into the pressure roller 20 between the recording medium entrance of the fixation nip N and the downstream end K of the portion A of the recording medium pressing surface of the heating unit is such that the closer to the point K, the greater the amount of the invasion; in other words, the relationship between the amount of the invasion and the distance from the recording medium entrance of the fixation nip N is roughly linear, and is maximum at the point K.

Therefore, as the recording medium S is conveyed through the fixation nip N, the amount of the pressure applied to the recording medium S by the fixation nip N begins to increase at the recording medium entrance of the fixation nip N, and roughly linearly increases until the recording medium S reaches the downstream end K of the portion A of the fixing film pressing surface of the heating unit past the center of the fixation nip N (center between recording medium entrance to exit), reaching its peak at the point K.

Also in this embodiment, the fixation film pressing surface of the heating unit (heating member) is provided with the second portion B, which is the portion between the downstream end K of the portion A and the recording medium exit of the fixation nip N, and is virtually flat. Therefore, the amount of the invasion of the heating unit into the pressure roller 20 between the downstream end K of the portion A and the recording medium exit of the fixation nip N is such that the closer to the exit, the smaller the amount of the invasion, and the relationship between the distance from the point K to a given point in this range, and the amount of the invasion is roughly linear.

Therefore, as the recording medium S is conveyed through the fixation nip N, the amount of the pressure applied to the recording medium S by the fixation nip N begins to decrease at the downstream end K of the portion A, and steeply decreases until it falls to virtually zero at the recording medium exit of the fixation nip N.

Figure 5:
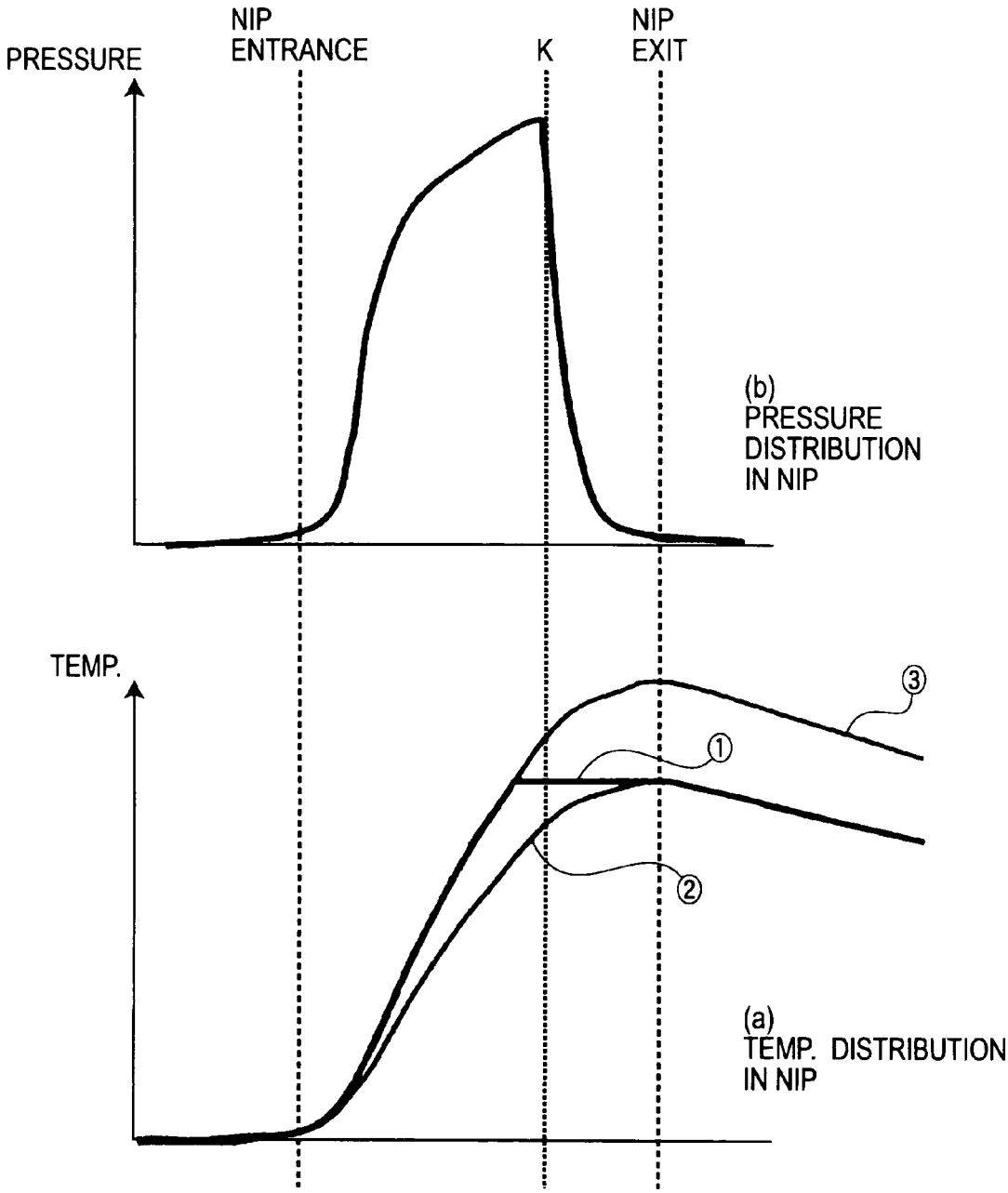
FIG. 5 is a graph showing the temperature and pressure distributions of the fixation nip.
Figures 1, 6:
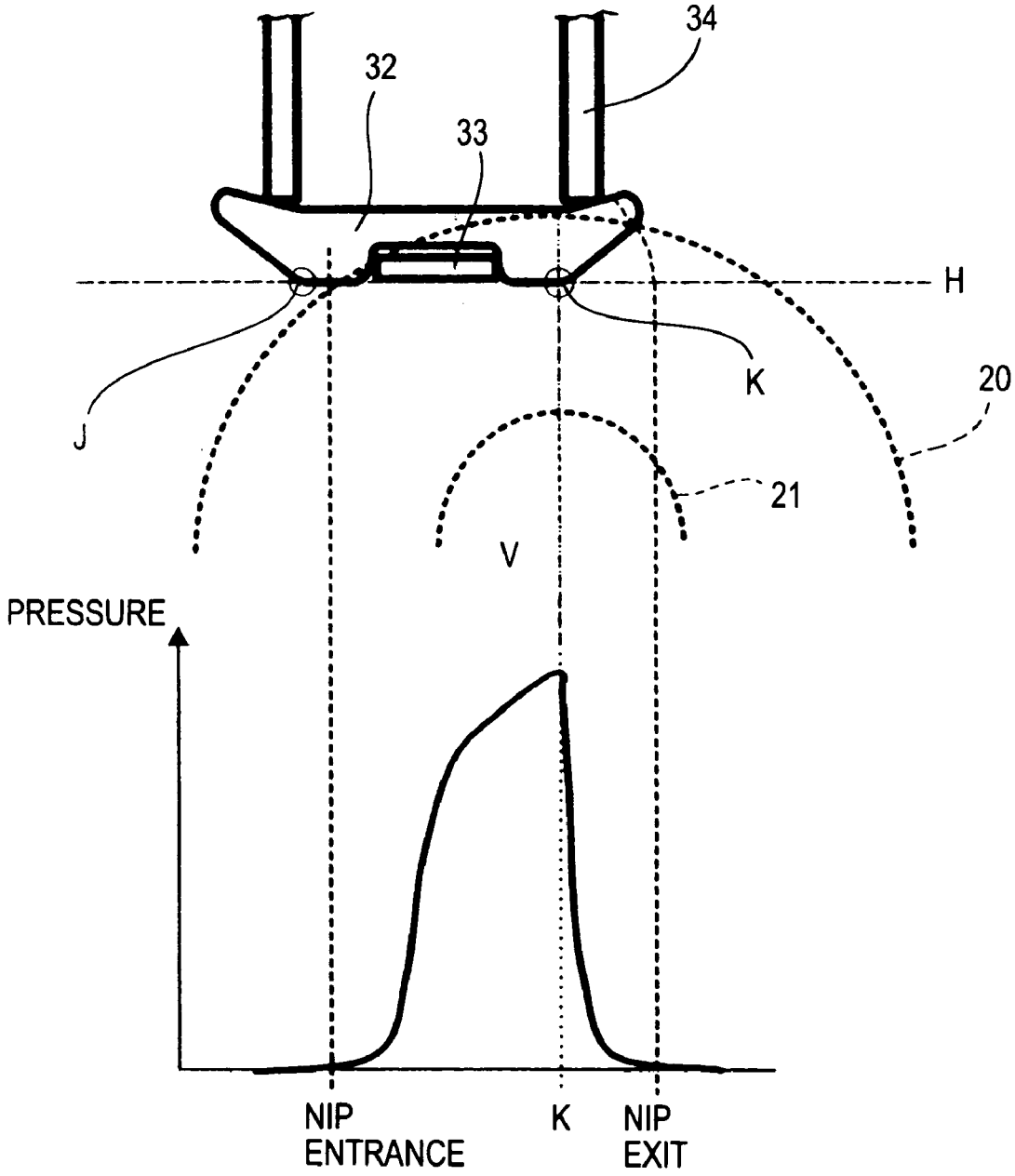
Figures 2, 6:
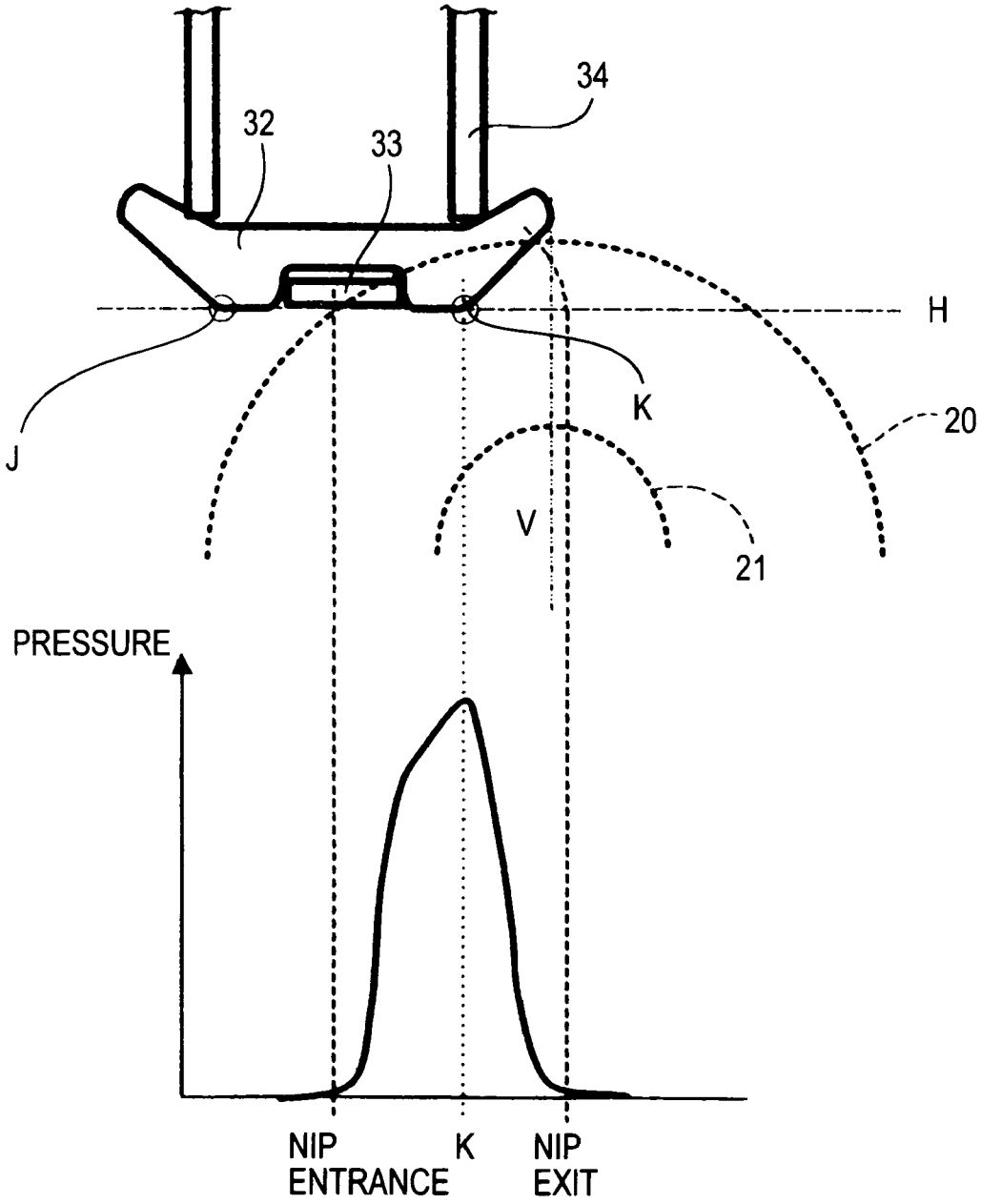
Figures 3, 6:
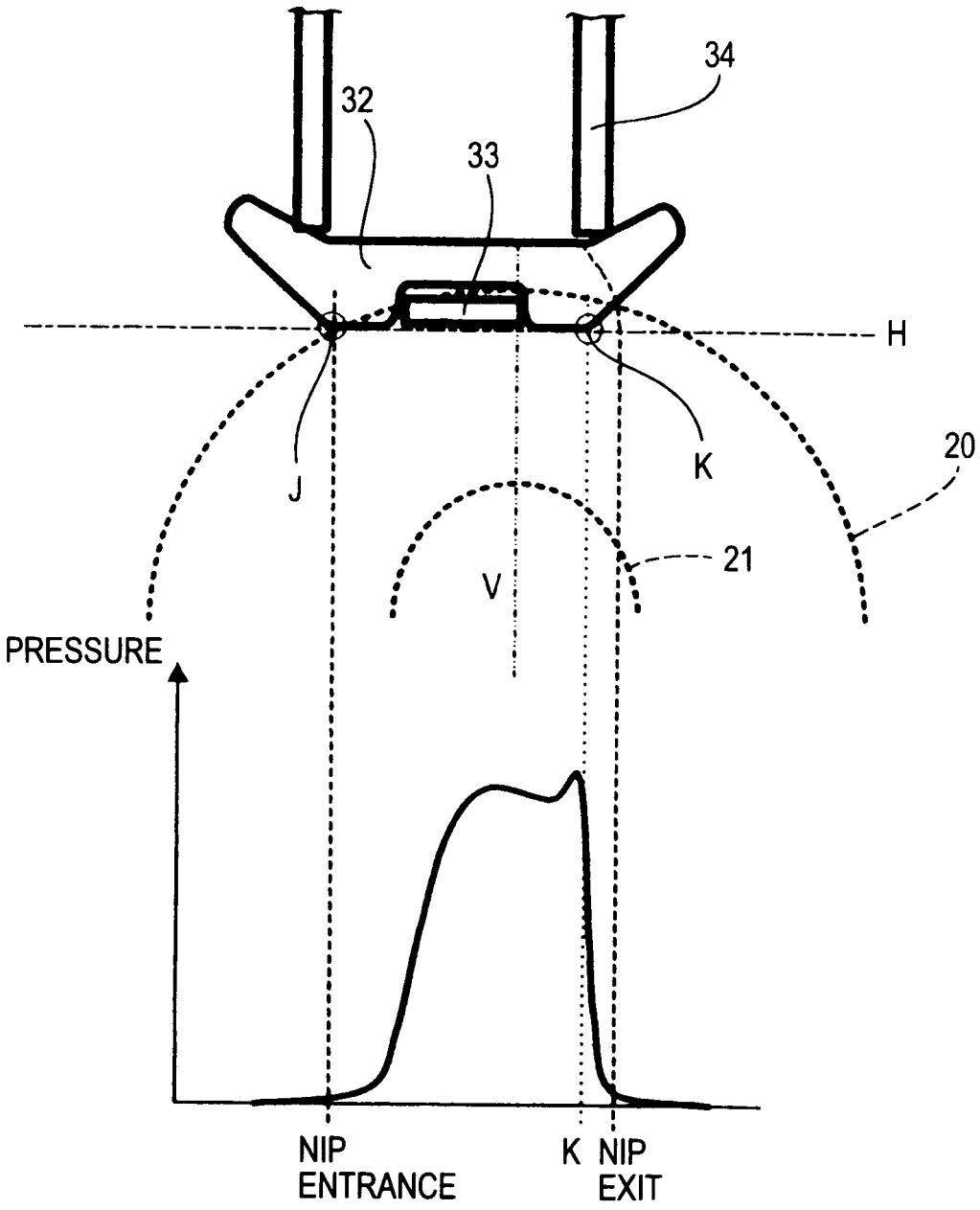

Further, the temperature distribution in the fixation nip N is as represented by Line 1 in FIG. 5(*a*).

As for the temperature distribution of the fixation nip N, the portion of the fixation nip N, which extends from the recording medium entrance to the area immediately before the downstream end K of the portion A, via the center of the fixation nip N, is heated by the heating plate 33, the internal temperature of the fixation nip N linearly increases toward the area immediately before the downstream end K. Since the heating plate 33 is on the upstream of the downstream end K of the portion A, in terms of the recording medium conveyance direction, in the fixation nip N, the internal temperature of the fixation nip N reaches the predetermined temperature level before the point K. Further, no heat source (heating plate 33) is on the downstream side of the point K, in terms of the recording medium conveyance direction. Therefore, after the downstream end K, the internal temperature of the fixation nip N remains roughly the same toward the recording medium exit of the fixation nip N.

Figure 24:
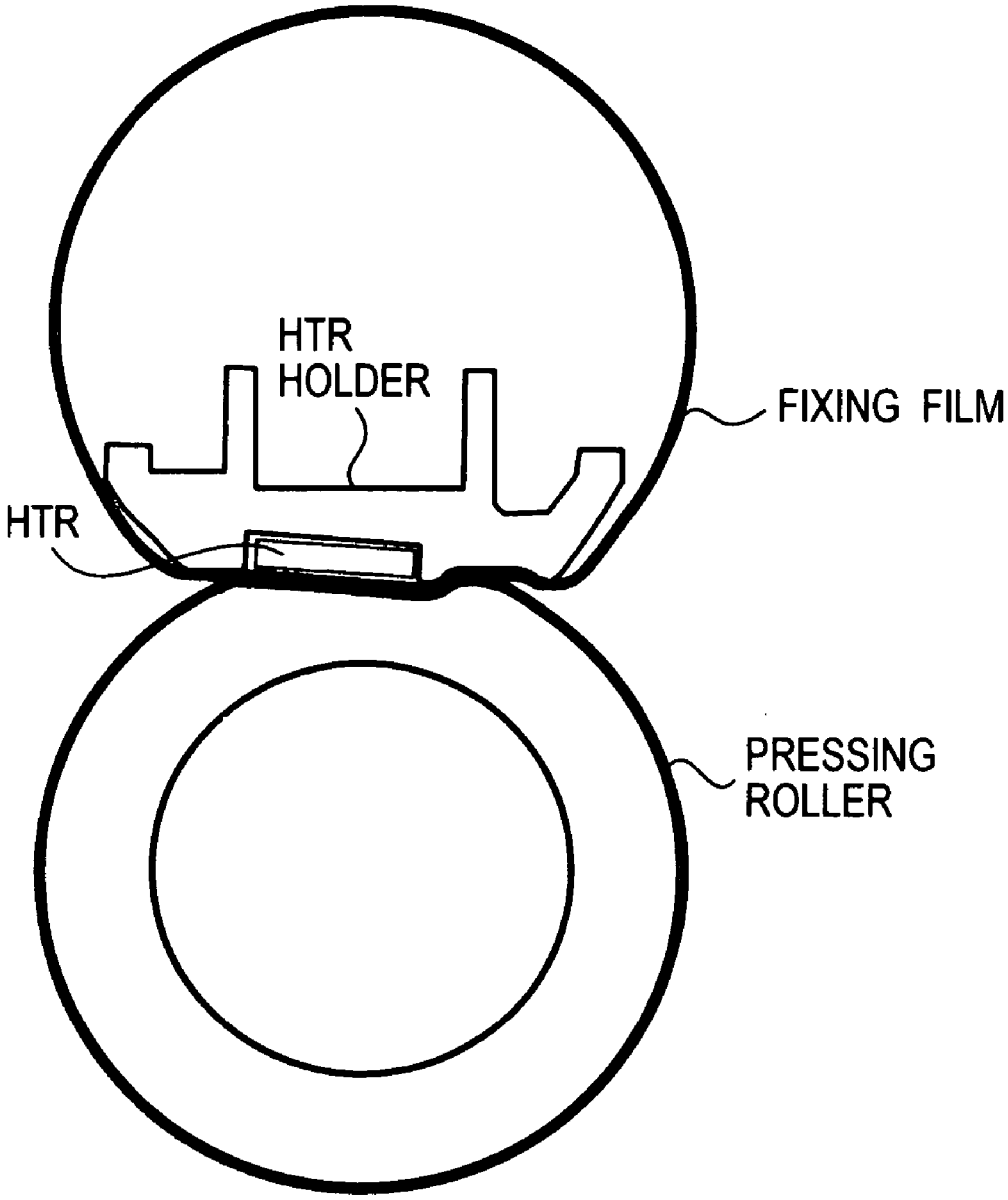
FIG. 24 is a schematic sectional view of the fixing apparatus in the first embodiment of the present invention, showing the practical structure thereof.
Figure 25:
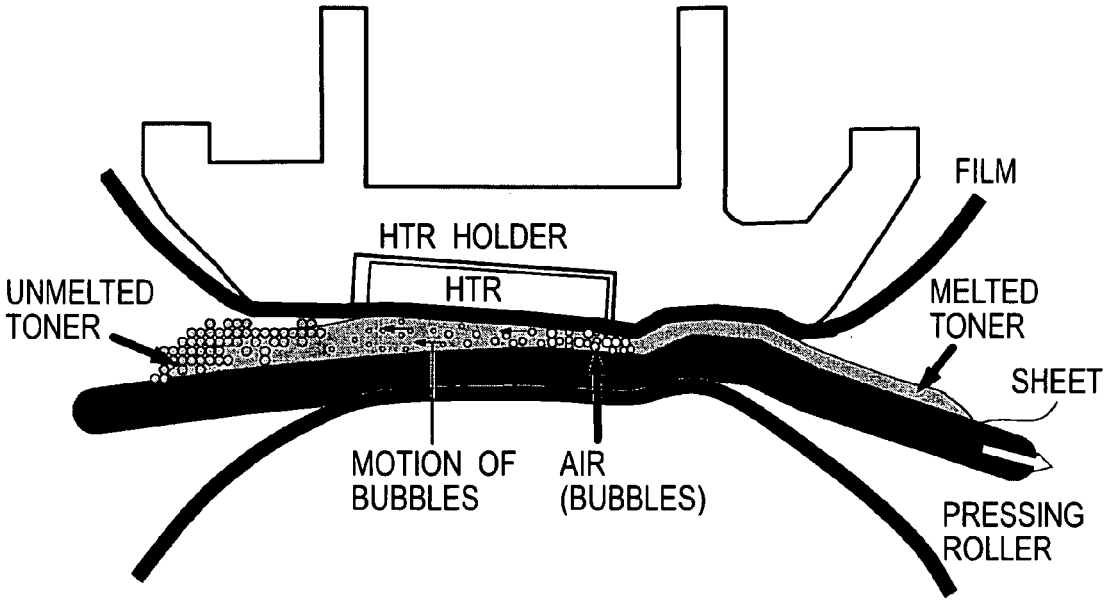
FIG. 25 is a schematic drawing showing the changes in the state of fixation which occur at a given portion of the toner layer as the given portion is moved through the fixation nip of the fixing apparatus in the first embodiment of the present invention.

It is reasonable to think that as the combination of the recording medium S and the unfixed toner image on the recording medium is moved through the fixation nip N while pressure and heat is applied to the toner as described above, the toner image on the recording medium S is melted as described next with reference to FIGS. 7, 24, and 25, which show the changes in physical form of the toner in the fixation nip N in this embodiment. FIG. 24 shows in detail the actual structure of the essential portion of the fixing apparatus in this embodiment, and FIG. 25 shows the progression of the fixation process, in terms of the physical form of the toner, in the fixation apparatus shown in FIG. 24. In FIG. 25, paper thickness, toner particle diameter, etc., are exaggerated.

Figure 7:
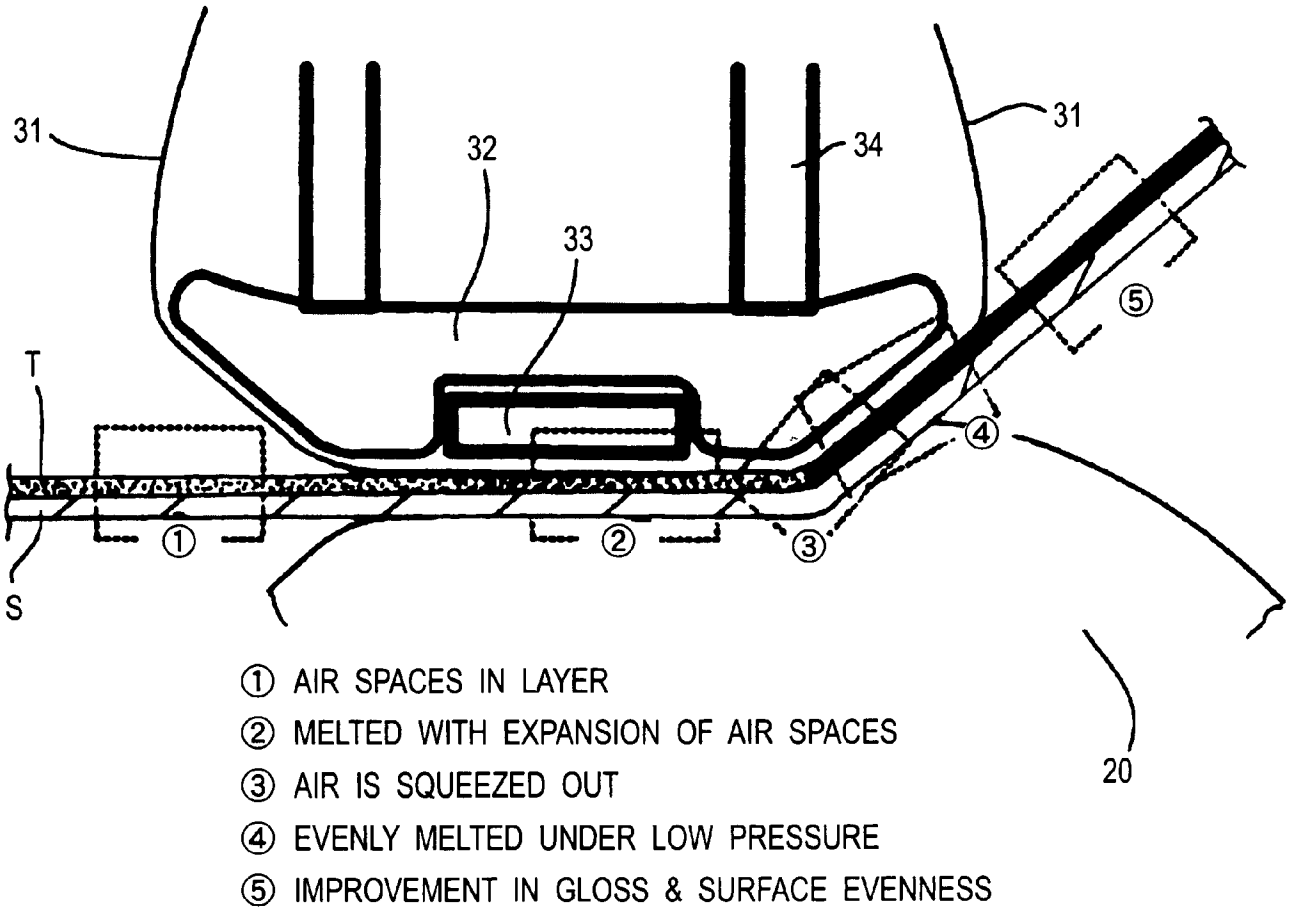
FIG. 7 is an enlarged schematic sectional view of the fixation nip, showing the changes which occur to a given portion of the toner layer as the given portion of the toner layer is moved through the heated fixation nip.

First, it is thought that prior to the entry into the fixation nip N of the fixing apparatus 10, the state of the toner layer (toner image T) on the recording medium S is as depicted in the area in FIG. 7, or as depicted in FIG. 25. In other words, there are four layers of toner images T having been sequentially transferred in layers onto the recording medium S from the four photosensitive drums 1*a*–1*d*. When the toner images T were transferred onto the recording medium S, they were not transferred so that no gap was left between the adjacent two toner layers (toner images T). In other words, there are a certain number of minute pockets of air between the adjacent two toner layers (toner images T).

While the recording medium S is conveyed from the recording medium entrance of the fixation nip N to the downstream end K of the portion A of the fixation film pressing surface of the heating unit, the amount of the heat applied to the toner layers on the recording medium S by the fixing nip N linearly increases as represented by Line 1 in FIG. 5, and the amount of the pressure applied to the recording medium S by the fixation nip N roughly linearly increases as shown in FIG. 5(*b*). Therefore, while the recording medium S is conveyed from the recording medium entrance of the fixation nip N to the downstream end K of the portion A of the fixation film pressing surface of the heating unit, the toner layers on the recording medium S gradually melt, while remaining in contact with the fixation film 31, as shown in the area 2 in FIG. 7, and FIG. 25. While the toner layers melt, the minute pockets of air in the toner layers gradually expand in the melting toner layers. By the time a given portion of the recording medium S reaches the downstream end K, the toner layers thereon are thoroughly melted by the heat from the heating plate 33.

Referring to FIG. 5(*b*), the amount of the pressure applied to the toner layers on the recording medium S by the fixation nip N is highest at the downstream end K. Further, while the recording medium S is conveyed from the recording medium entrance of the fixation nip N to the point K, or the point at which the fixation nip pressure is highest, the amount of the pressure applied to the toner layers on the recording medium S continuously increases, that is, with virtually no decrease, keeping thereby the toner layers on the recording medium S perfectly in contact with the fixation film, in terms of the lengthwise direction of the fixation nip N. Therefore, by the time the recording medium S is conveyed to the point K, or the point at which the internal pressure of the fixation nip N is highest, the toner layers are thoroughly melted. Then, as the recording medium S is moved past the downstream end K, the melted toner layers are uniformly squeezed in terms of the lengthwise direction of the downstream end K. As a result, the pockets of air in the toner layers are completely squeezed out of the toner layers by the squeezing function of the downstream end K as shown in the area 3 in FIG. 7, and FIG. 25. In other words, there remains no pockets of air in the portions of the toner layers having been moved past the downstream end K. In comparison, if the fixation nip N has an area in which the amount of the pressure applied to the recording medium S is smaller than that applied in the immediately upstream area thereof, and which is located on the upstream side of the maximum pressure point K, this area prevents the toner layers from being satisfactorily melted. As a result, the toner layers fail to be satisfactorily squeezed to purge the pockets of air therein, at the downstream end K of the portion A of the fixation film pressing surface of the heating unit.

While the recording medium S is conveyed from the downstream end K to the recording medium exit of the fixation nip N, the temperature level of the toner layers remains roughly the same, as represented by Line 1 in FIG. 5(*a*), whereas the amount of the pressure applied to the toner layers steeply falls as shown in FIG. 5(*b*). Therefore, the toner layers are more uniformly melted, while maintaining a certain degree of elasticity, and being subjected to the small amount of pressure, as shown in Area 4 in FIG. 25.

Since the temperature of the toner layers remains roughly the same while the recording medium S is conveyed from the downstream end K to the recording medium exit of the fixation nip N, the toner layers still maintain a certain level of elasticity at the recording medium exit of the fixation nip N. Therefore, the toner layers can be smoothly separated from the fixation film 31. Also, while the recording medium S is conveyed from the downstream end K to the recording medium exit of the fixation nip N, it is kept pressed, along with the fixation film 31, against the second portion B of the fixation film pressing surface of the heating unit, on the downstream side of the downstream end K. Therefore, the curvature given to the recording medium S at the downstream end K in the fixation nip N is properly removed. In addition, the fixation film 31 is pulled in the direction in which it is circularly moved. Therefore, the recording medium S cleanly separates from the fixation film 31; it does not remain wrapped around the fixation film 31.

Through the above described process, the toner layers on the recording medium S are fixed to the recording medium S, turning into an image which is highly glossy, and also, uniform in the other surface properties. Thereafter, the recording medium S is outputted from the main assembly of the image forming apparatus.

As will be evident from the description of the structure of the fixing apparatus in this embodiment, the employment of the above described structural arrangement for the fixing apparatus affords more latitude in the setting of a fixing apparatus regarding hot offset, making it possible to output a permanent copy of an intended image, which does not suffer from hot offset, is superior in glossiness, is uniform in surface properties, and does not curl or remain adhered to the fixation film.

Incidentally, the application of the present invention is not limited to a fixing apparatus such as the fixing apparatus in this embodiment in which there is no difference in elevation between the fixation film pressing slippery surface of the heating plate 33 and the fixation film pressing slippery surface of the heating plate holder 32. In other words, all that is necessary is that there is virtually no area, between the fixation film pressing slippery surface of the heating plate 33 and the point K (at which internal pressure of fixation nip is highest), in which the amount of the internal pressure of the fixation nip N is smaller than that in the immediately upstream area thereof. In other words, the structure for a fixing apparatus may be such that the downstream end of the fixation film pressing slippery surface of the heating plate 33, in terms of the recording medium conveyance direction, is slightly lower in elevation than the portion of the fixation film pressing surface of the heating member holder, next to the downstream end of the heating plate 33, in terms of the recording medium conveyance direction. The studies made by the inventors of the present invention revealed that as long as the difference in elevation between the downstream end of the fixation film pressing slippery surface of the heating plate 33 and the upstream end of the fixation film pressing surface of the heating plate holder, next to the downstream end of the heating plate 33, is no more than 100 μm, the effect of the reduction in the internal pressure of the fixation nip N caused by this difference in elevation is negligible.

Further, the structure of a fixing apparatus may be such that the downstream end of the fixation film pressing slippery surface of the heating plate 33, in terms of the recording medium conveyance direction, is slightly higher in elevation than the upstream end of the fixation film pressing surface of the heating plate holder, immediately after the heating plate 33, in terms of the recording medium conveyance direction. In such a case, the downstream end of the fixation film pressing slippery surface of the heating plate 33 in terms of the recording medium conveyance direction is where the internal pressure of the fixation nip N is highest. However, if the point at which the internal pressure of the fixation nip N is highest coincides with the downstream end of the fixation film pressing slippery surface of the heating plate 33 in terms of the recording medium conveyance direction, the inward surface of the fixation film is shaved by the edge of the heating plate 33. Therefore, the structure of a fixing apparatus is desired to such that the point at which the internal pressure of the fixation nip N is highest is created by the heater holder 32.

Further, even if there is a slight gap (in terms of recording medium conveyance direction) between the downstream end of the heating plate 33 and the upstream wall of the recess of the heater holder 32, in which the heating plate 33 is embedded, it does not matter. The studies made by the inventors of the present invention revealed that as long as this gap is no more than 300 μm, the pressure reduction caused by this gap is virtually negligible.

According to the above described structure of the fixing apparatus in this embodiment, the upstream end J of the recording medium pressing portion A of the fixing film pressing slippery surface of the heating unit is on the upstream side of the recording medium entrance of the fixation nip N in terms of the recording medium conveyance direction. However, the upstream end J of the recording medium pressing portion A made up of the outward surfaces of the heating plate 33 and heating plate holder 32 has only to coincide with the recording medium entrance of the fixation nip N, or on the upstream side the recording medium entrance of the fixation nip N.

The employment of the above described structure which makes the end J coincide with the recording medium entrance of the fixation nip N, or be on the upstream side of the recording medium entrance of the fixation nip N, makes it possible to make the other end K coincide with the point in the fixation nip N at which the internal pressure of the fixation nip N is highest, and also, make the internal pressure of the fixation nip N drastically lower on the upstream side of the downstream end K than on the upstream side of the downstream end K. Therefore, the toner layers are very effectively squeezed at the downstream end K; in other words, the effects of the present invention are fully realized.

If the end J of the recording medium pressing portion A made up of the outward surfaces of the heating plate 33 and heating plate holder 32 is in the fixation nip N, the internal pressure of the fixation nip N is higher at the point coinciding with the upstream end J of the portion A than that in the adjacencies of that point, making less drastic the difference in the internal pressure between the portion of the fixation nip N on the immediately upstream side of the end K and the portion of the fixation nip N on the immediately downstream side of the end K. Therefore, the portion of the fixation nip N corresponding in position to the downstream end K of the recording medium pressing portion A fails to apply high pressure while the toner is in the thoroughly melted state; in other words, the effects of the present invention cannot be realized. However, a fixing apparatus may be structured so that the upstream end J is located inward of the fixation nip N, as long as the amount of the reduction in the difference in the internal pressure between the portion of the fixation nip N on the immediately upstream side of the downstream end K and the portion of the fixation nip N on the immediately downstream side of the downstream end K, which is caused by the structural arrangement which places the upstream end J in the fixation nip N, is virtually negligible.

Further, as described above, the fixing apparatus in this embodiment is structured so that the downstream end K roughly coincides with the intersection of the hypothetical plane H connecting the upstream and downstream ends J and K of the recording medium pressing portion A of the fixation film pressing surface of the heating unit, and the hypothetical plane V perpendicular to the hypothetical plane H and coinciding with the rotational axis of the pressure roller 20 (distance from hypothetical plane V to downstream end K is virtually zero), as shown in FIG. 6-1. With the provision of this positional arrangement, the amount of the invasion of the recording medium pressing portion A of the fixation film pressing surface of the heating unit into the pressure roller 20 between the recording medium entrance of the fixation nip N and the downstream end K of the portion A of the fixation film pressing surface of the heating unit is such that the closer to the point K, the greater the amount of the invasion; in other words, the relationship between the amount of the invasion and the distance from the recording medium entrance of the fixation nip N is roughly linear, and the internal pressure of the fixation nip N is maximum at the point K. However, the employment of the structural arrangement, in this embodiment, for a fixing apparatus is not mandatory to make the internal pressure of the fixation nip N highest at the downstream end K. In other words, one of the essential aspects of the present invention is the manner in which, and the distance by which, the heating unit, more specifically, the downstream end K, is made to invade into the pressure roller 20.

If the fixing apparatus is structured so that the downstream end K deviates upstream, in terms of the recording medium conveyance direction, by a substantial distance from the normal position of the downstream end K in this embodiment (position in FIG. 6-1), the distribution of the internal pressure of the fixation nip N becomes as shown in FIG. 6-2. That is, the distribution curve of the internal pressure of the fixation nip N remains definitely sharp, but the distance from the recording medium entrance of the fixation nip N to the point of the fixation nip N (downstream end K) at which the internal pressure of the fixation nip N is highest, becomes shorter, reducing the size of the heating portion of the fixation nip N.

On the other hand, if the fixing apparatus is structured so that the downstream end K deviates downstream, in terms of the recording medium conveyance direction, by a substantial distance, from the normal position of the downstream end K in this embodiment, the distribution of the internal pressure of the fixation nip N becomes as shown in FIG. 6-3. That is, the distribution curve of the internal pressure of the fixation nip N becomes dull, making the present invention less effective.

Figure 8:
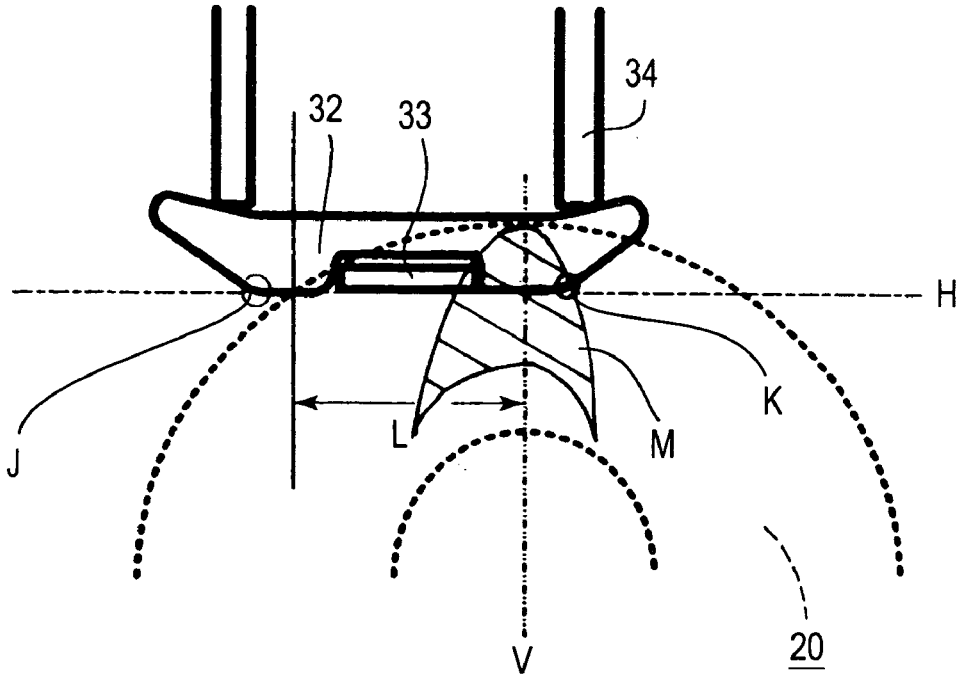
FIG. 8 is a schematic sectional view of the fixation nip and its adjacencies, depicting the details thereof.

Thus, the present invention requires a fixing apparatus to be structured to satisfy the following conditions, which will be described with reference to FIG. 8, in which a referential letter H designates the hypothetical plane coinciding with the slippery outward surface of the heating plate 33; a referential letter V designates the hypothetical plane perpendicular to the plane H and coinciding with the rotational axis of the pressure roller; and a referential letter L stands for the distance between the line perpendicular to the plane H and coinciding with the intersection of the plane H and the peripheral surface of the pressure roller 20 (FIG. 8 shows only the distance L on the upstream side of the plane V in terms of the recording medium conveyance direction; the distance L is present on the downstream side of the plane V). All that is necessary for the present invention to be effective is that a fixing apparatus is structured so that the downstream end K is positioned in the hatched area M in FIG. 8; in other words, it is positioned upstream of the plane V, in terms of the recording medium conveyance direction, and the distance between the downstream end K and the plane V is no more than "half of the distance L", preferably, no more than "one third of the length L", more preferably, no more than "one quarter of the length L". The hatched portion M in FIG. 8 represents the area in which the distance between the downstream end K and the plane V is no more than "one third of the length L on the upstream side of the plane V", and the area in which the distance between the downstream end K and the plane V is no more than "one quarter of the length L on the downstream side of the plane V", in terms of the recording medium conveyance direction.

To describe in more detail the above described conditions with reference to FIG. 8, the referential letter L stands for the distance between the plane V to the recording medium entrance of the fixation nip N, in the sectional view of the fixation nip N at the plane H. The portion of the borderline of the hatched area M, on the upstream side of the plane V, is where the distance from the plane V is roughly one third of L, whereas the portion of the borderline of the hatched area M, on the downstream side of the plane V, is where the distance from the plane V is roughly one quarter of L. In other words, as the amount by which the heating unit is made to invade into the pressure roller (as plane H shifts upward in FIG. 8) is reduced, the distance L reduces, reducing thereby the size of the hatched area M. On the other hand, as the amount by which the heating unit is made to invade into the pressure roller (as plane H shifts downward in FIG. 8) is increased, the distance L increases, increasing thereby the size of the hatched area M. Therefore, the borderline of the hatched area M curves. Further, since the proper range for the position of the downstream end K, on the downstream side of the plane V, in FIG. 8, is no more than one quarter of the distance L from the plane V, being different from that on the upstream side, that is, no more than one third of the distance L. Therefore, the portion of the curved borderline of the area M, on the upstream side of the plane V, is slightly different from that on the downstream side of the plane V. However, the proper range for the position of the downstream end K, on the downstream side of the plane V, may extend as far as one half of the distance L, as described above. The reason for the inward curvature of the bottom portion of the borderline of the hatched area M is as follows. That is, if the heating unit is made to invade into the pressure roller by an amount greater than a certain value, even the upstream end J of the recording medium pressing portion A is made to invade into the pressure roller, although the position of the downstream end K still satisfies the condition that the distance of the downstream end K from the plane V must be no more than ⅓ and ¼ of the distances L, on the upstream and downstream sides of the plane V, respectively. Therefore, such an area must be eliminated from the proper area for the placement of the downstream end K, and the elimination of such an area causes the borderline of the hatched area M to inwardly curve.

Further, in the above described embodiment of the present invention, the first recording medium pressing portion A, that is, the portion of fixation film pressing slippery surface of the heating member, from the upstream end J of the recording medium pressing portion of the fixation film pressing slippery surface made up of the outward surfaces of the heating plate 33 and heating plate holder 32, to the point (downstream end K of first portion A), at which the internal pressure of the fixation nip N is highest, was defined as a flat surface. However, all that is necessary is that the first recording medium pressing slippery portion A is configured so that the closer to the downstream end K, the higher the fixation pressure. In other words, all that is necessary is that the portion A does not curve upward relative to the plane H coinciding with the upstream J of the recording medium pressing portion of the fixation film pressing slippery surface made up of the outward surfaces of the heating plate 33 and heating member holder 32, and the line (downstream end K) at which the internal pressure of the fixation nip N is highest; the portion A may curve slightly downward.

Figure 9:
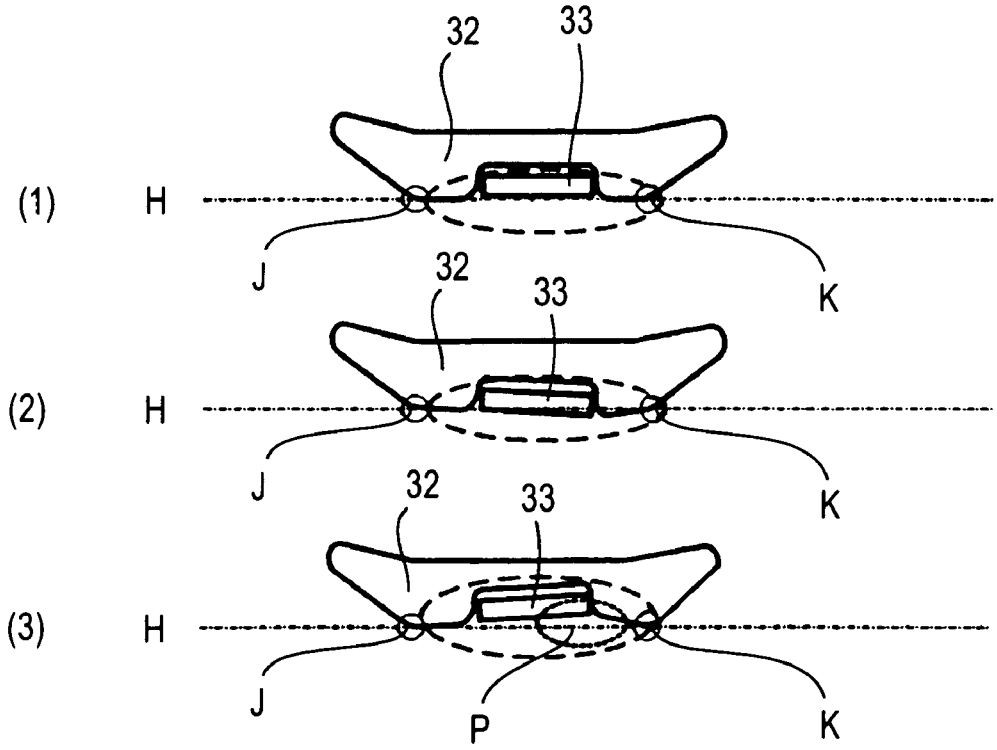
FIG. 9 is a schematic sectional view of the fixation nip and its adjacencies of a fixing apparatus, depicting the structure of the recording medium pressing slippery area of the fixation nip.

As long as the first recording medium pressing portion A is flat or curves downward as shown in FIGS. 9(1) and 9(2), the distribution of the internal pressure of the fixation nip N across the first portion A becomes such that the closer to the downstream end of the first portion A, the higher the internal pressure. Therefore, there is no area in the portion of the fixation nip N, corresponding to the first portion A, in which the amount of the pressure which applies to the recording medium S is less than that which applies to the recording medium S in the immediately preceding area in terms of the recording medium conveyance direction. Therefore, as the combination of the recording medium S and toner images thereon is conveyed through this portion of the fixation nip N, it is kept perfectly in contact with the fixation film, in terms of the lengthwise direction of the fixation nip N, being thereby uniformly squeezed in terms of the lengthwise direction of the fixation nip N. As a result, the level of uniformity in surface properties, in particular, glossiness, at which an image is outputted improves.

If the first recording medium pressing portion A curves toward the heating unit as shown in FIG. 9(3), the fixation pressure of the fixation nip N is lower in the area P. Therefore, while the recording medium S is conveyed through this area P, the combination of the recording medium S and the toner images thereon cannot be perfectly in contact with the fixation film, being therefore unevenly squeezed in terms of the lengthwise direction of the fixation nip N. As a result, the level of uniformity in surface properties, in particular, glossiness, at which an image is outputted falls.

Figure 10:
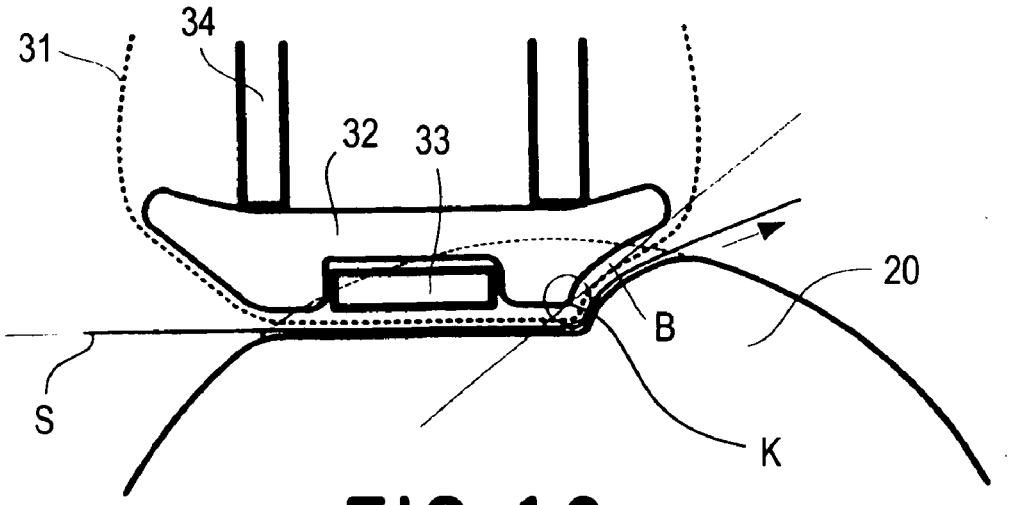
FIG. 10 is a schematic sectional view of a modified slippery area.
Figure 11:
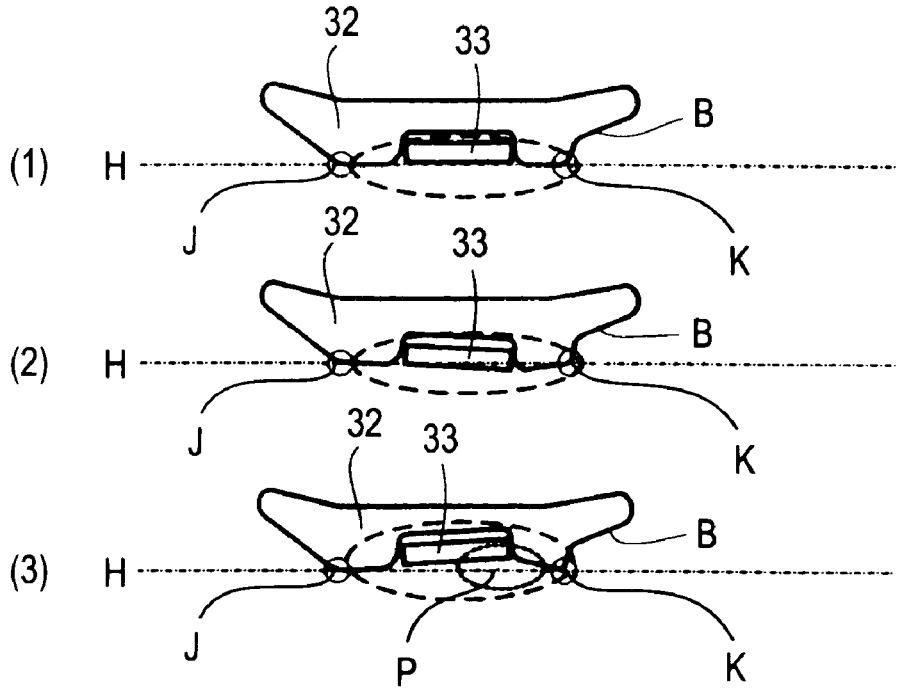
FIG. 11 is a schematic sectional view of another modified slippery area.
Figure 12:
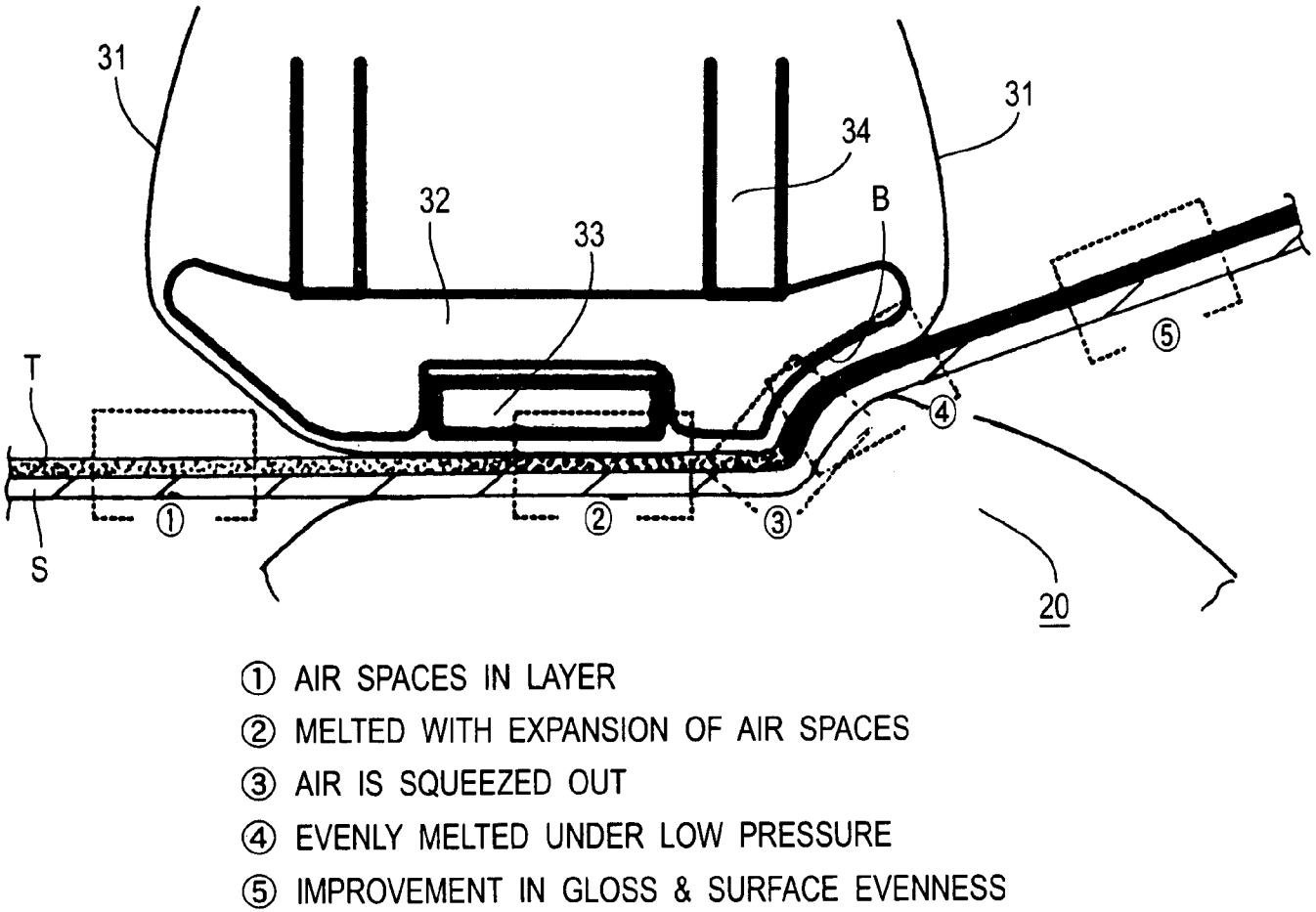
FIG. 12 is an enlarged schematic sectional view of the fixation nip and its adjacencies, showing the changes which occur to a given portion of the toner layer as the given portion of the toner layer is moved through the slippery portion of the fixation nip shown in FIG. 10.

Further, in the above described embodiment of the present invention, the structure of the portion of the fixation nip N after the downstream end K, at which the internal pressure of the fixation nip N is highest, in terms of the recording medium conveyance direction, in other words, the structure of the recording medium pressing portion B, is such that the entirety of the portion B was flat. However, it is not mandatory that the entirety of the portion B is flat. For example, the portion B may curve inward of the heating unit as shown in FIGS. 10–12, 24, and 25, for the following reason. That is, even if the portion B curves inward of the heating unit, the recording medium S is kept pressed, along the fixation film S, against the portion B by the pressure roller 20, being thereby made to conform to the inward curvature of the portion B, being thereby prevented from curving toward the fixation film. In addition, the recording medium exit of the fixation nip N is preceded, in terms of the recording medium conveyance direction, by the inward curvature of the recording medium pressing portion B. Therefore, as the fixation film 31 is pulled to be circularly rotated around the heating unit, the recording medium S more smoothly separates from the fixation film S. In other words, making the recording medium pressing portion B slightly inwardly curve does not adversely affect the present invention. Incidentally, the fixation nips N in FIGS. 10–12 are the same as those in FIGS. 4, 9, and 7, except for the inward curving of the recording medium pressing portion B, and therefore, will not be described here.

The heating plate 33 and heating member holder 32, the outwardly facing surfaces of which make up the fixation film pressing surface of the heating unit, are rigid members, making it easier to structurally control the amount of the pressure F applied by them.

EXAMPLE 1 COMPARABLE TO EMBODIMENT 1

Figure 13:
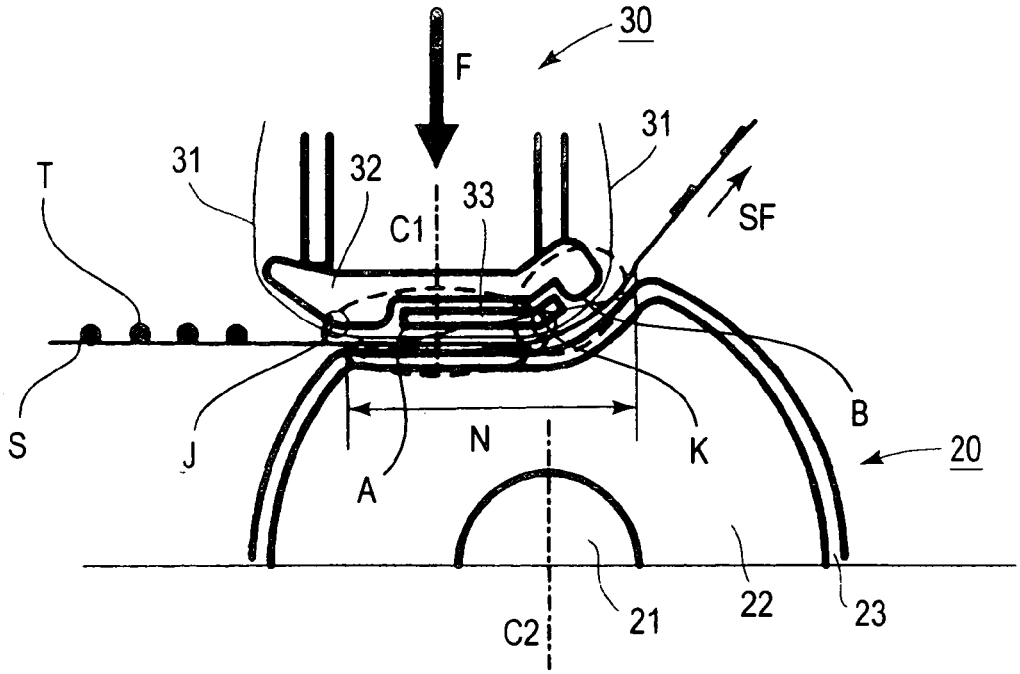
FIG. 13 is a schematic sectional view of the first example of a fixing apparatus comparable to the fixing apparatus in the first embodiment, showing the structure thereof.
Figure 14:
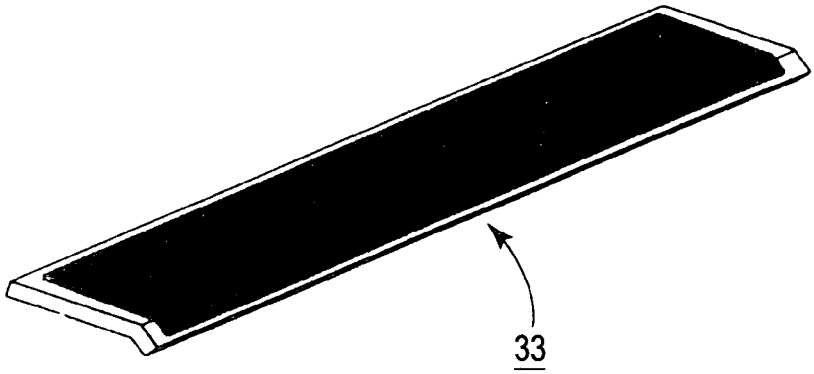
FIG. 14 is a schematic perspective view of the heating member of the first example of a fixing apparatus comparable to the fixing apparatus in the first embodiment.

FIG. 13 is a schematic sectional view of the essential portion of the first example of a fixing apparatus comparable to that in the first embodiment. FIG. 14 is an external perspective view of the heating member of the first example of a fixing apparatus comparable to that in the first embodiment. The structural members and portions of this fixing apparatus identical to those in the first embodiment will be given referential symbols identical to those in the first embodiment, and will not be described here.

The difference between the first example of a fixing apparatus comparable to the fixing apparatus in the first embodiment and the fixing apparatus in the first embodiment is that the heating member in this example of a fixing apparatus is wide enough, in terms of the recording medium conveyance direction, to extend downstream beyond the downstream end K, at which the fixation pressure of the fixation nip N is highest. Otherwise, the two fixing apparatuses are the same in structure.

Here, referring to the temperature and pressure distributions of the fixation nip N in FIG. 5, the difference between the first example of a fixing apparatus comparable to the fixing apparatus in the first embodiment, and the fixing apparatus in the first embodiment, will be described.

The difference between the first comparative example and first embodiment is that the heating member in this example of a fixing apparatus is wide enough, in terms of the recording medium conveyance direction, to extend downstream beyond the downstream end K, at which the fixation pressure of the fixation nip N is highest. Otherwise, the two fixing apparatuses are the same in structure. Therefore, the distribution of the internal pressure of the fixation nip N in this example, is the same as that in the first embodiment shown in FIG. 5(*b*).

In this comparative example, however, the heating member 33 is wide enough, in terms of the recording medium conveyance direction, to make contact with the fixation film 31 across virtually the entire range of the fixation nip N in terms of the recording medium conveyance direction. Therefore, heat is generated across virtually the entire range of the fixation nip N in terms of the recording medium conveyance direction. Therefore, the temperature curve (distribution) in the fixation nip N does not become one such as the one in the first embodiment, represented by Line 1 in FIG. 5(*a*), that the point at which the internal temperature (fixation temperature) of the fixation nip N becomes optimal for fixation is on the immediately upstream side of the point (downstream end K of recording medium pressing portion A) at which the internal pressure (fixation pressure) of the fixation nip N is highest.

In this first comparative example, therefore, even if the target temperature (fixation temperature) of the heating member is set to a level slightly below the level at or above which hot offset occurs, the internal temperature of the fixation nip N becomes highest on the downstream side of the downstream end K, at which the internal pressure of the fixation nip N is highest, in terms of the recording medium conveyance direction (Line 2 in FIG. 5(*a*)). Therefore, the toner on the recording medium S cannot be thoroughly melted by the time the recording medium S reaches the point K, at which the internal pressure of the fixation nip N is highest. Therefore, the minute pockets of air cannot be effectively squeezed out of the toner layers. As a result, the toner layers (toner images) cannot be uniformly fixed in terms of surface properties, in particular, glossiness; an outputted image is not as glossy as the one outputted from the image forming apparatus in the first embodiment.

On the other hand, if the target temperature level of the fixation apparatus in this example is set so that the internal temperature of the fixation nip N thereof at the point K, at which the internal pressure of the fixation nip N is highest, becomes the same as that in the first embodiment (Line 3 in FIG. 5(*a*)), the toner on the recording medium S will have been overheated by the time the recording medium S reaches the adjacencies of the recording medium exit of the fixation nip N, because, in the case of the fixation apparatus structure in this comparative example, the combination of the recording medium and the toner image thereon is continuously heated by the heating member 33 even after the combination is conveyed past the point K at which the internal pressure of the fixation nip N is highest. Therefore, the elasticity of the toner layers at the recording medium exit of the fixation nip N in this comparative example is lower than that in the first embodiment. As a result, hot offset occurs.

In other words, if a fixing apparatus is structured so that heating occurs throughout the fixation nip N as it does in the first comparative example, it becomes impossible to realize the effect of the present invention. This is why in the first embodiment, the heating member is disposed so that, in terms of the recording medium conveyance direction, the downstream end of the heating member is positioned on the upstream side of the point at which the internal pressure of the fixation nip N is highest.

EXAMPLE 2 COMPARABLE TO EMBODIMENT 1

Figure 15:
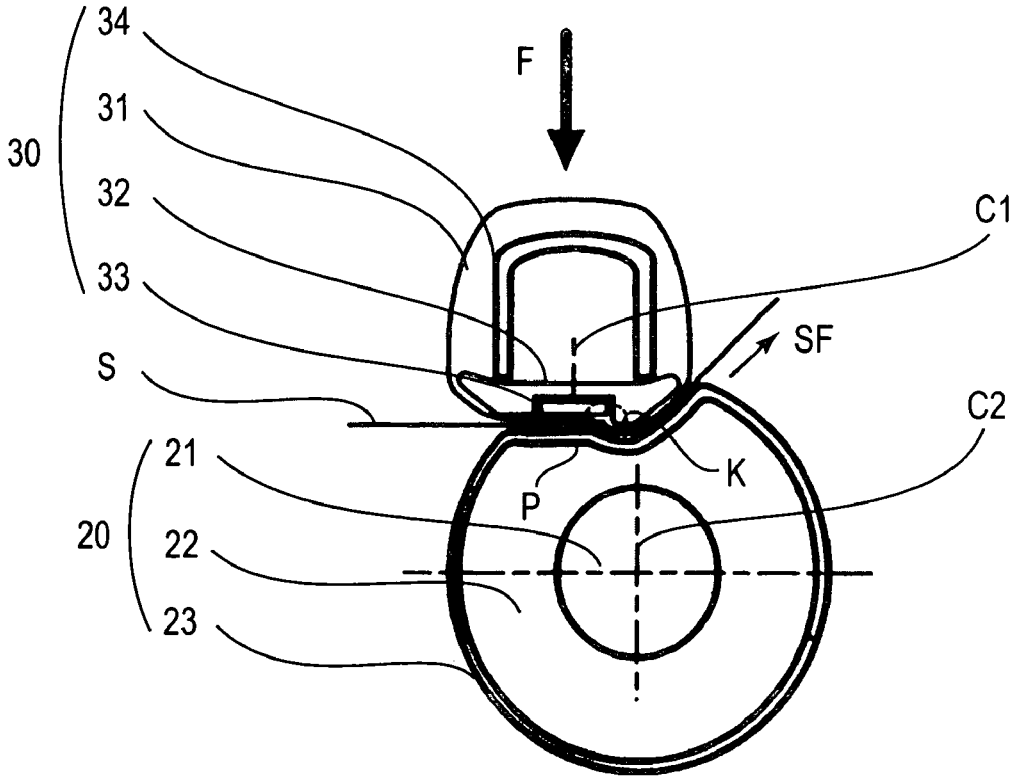
FIG. 15 is a schematic sectional view of the second example of a fixing apparatus comparable to the fixing apparatus, showing the structure thereof.
Figure 16:
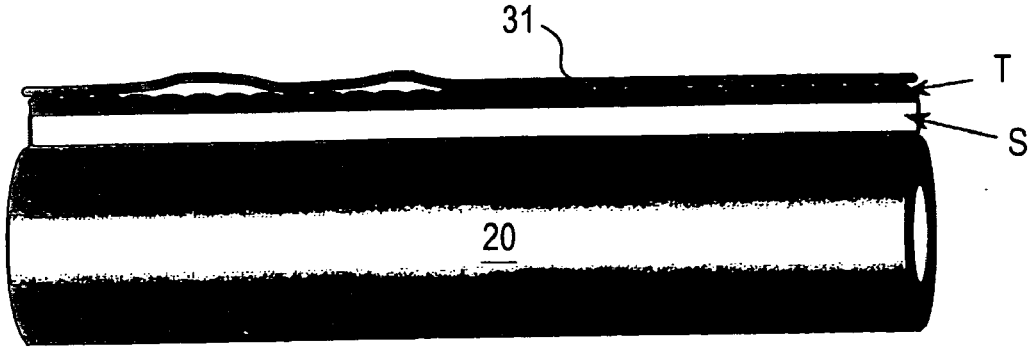
FIG. 16 is a schematic drawing depicting the problems of the second example of a fixing apparatus comparable to the fixing apparatus in the first embodiment.

FIG. 15 is a schematic sectional view of the second fixing apparatus comparable to that in the first embodiment. The structural members and portions of this fixing apparatus identical to those in the first embodiment will be given referential symbols identical to those in the first embodiment, and will not be described here.

The difference between this second comparative example of a fixing apparatus and the fixing apparatus in the first embodiment is that the portion of the heating member holder in this example of a fixing apparatus, on the downstream side of the heating member, is made to substantially (by no less than 100 μm) project inward of the pressure roller. Otherwise, the structure of this example of a fixing apparatus comparable to that in the first embodiment is the same as the structure of that in the first embodiment.

Next, referring to FIG. 15, the difference between the fixing apparatus in the first embodiment and this example of a fixing apparatus comparable to the fixing apparatus in the first embodiment will be described. It is feasible to place a rib-like member in the fixation nip N to locally increase the internal pressure of the fixation nip N in order to enhance the effect of the present invention that the pockets of air are squeezed out of the toner layers, in the fixation nip N. Definitely, providing the fixation nip N with a point at which the internal pressure of the fixation nip N is higher than its adjacencies assures that a glossier image is yielded. However, with the presence of an area such as the area P in FIG. 15, in which the internal pressure of the fixation nip N is lower than the immediately preceding area in terms of the recording medium conveyance direction, the amount of the pressure applied to the recording medium and the toner layers thereon by the fixation nip N temporarily reduces immediately before it becomes highest. Therefore, while the combination of the recording medium and the toner layers thereon is conveyed through this area like the area P, the contact between the combination of the recording medium S and the toner layers thereon and the fixation film becomes nonuniform, in terms of the lengthwise direction of the fixation nip N. Therefore, the heat transmission from the fixation film to the toner on the recording medium S becomes insufficient. Therefore, the toner fails to melt enough to achieve the level of viscosity necessary to allow the pockets of air to be squeezed out of the toner. As a result, a substantial number of pockets of air remain in the toner. In addition, the presence, in the fixation nip N, of the area in which the internal pressure of the fixation nip N is lower than the immediately preceding area in terms of the recording medium conveyance direction makes nonuniform, in terms of the lengthwise direction of the fixation nip N, the contact between the fixation film 31 and the toner T on the recording medium S. As a result, the fixation nip N becomes nonuniform, in terms of its lengthwise direction, in the effect of squeezing the pocket of air out of the toner T, making the fixing apparatus inferior in the uniformity of the surface properties, in particular, glossiness, of an image outputted from the fixing apparatus; an image which is nonuniform in glossiness in terms of the lengthwise direction of the fixation nip N is yielded.

Figure 17:
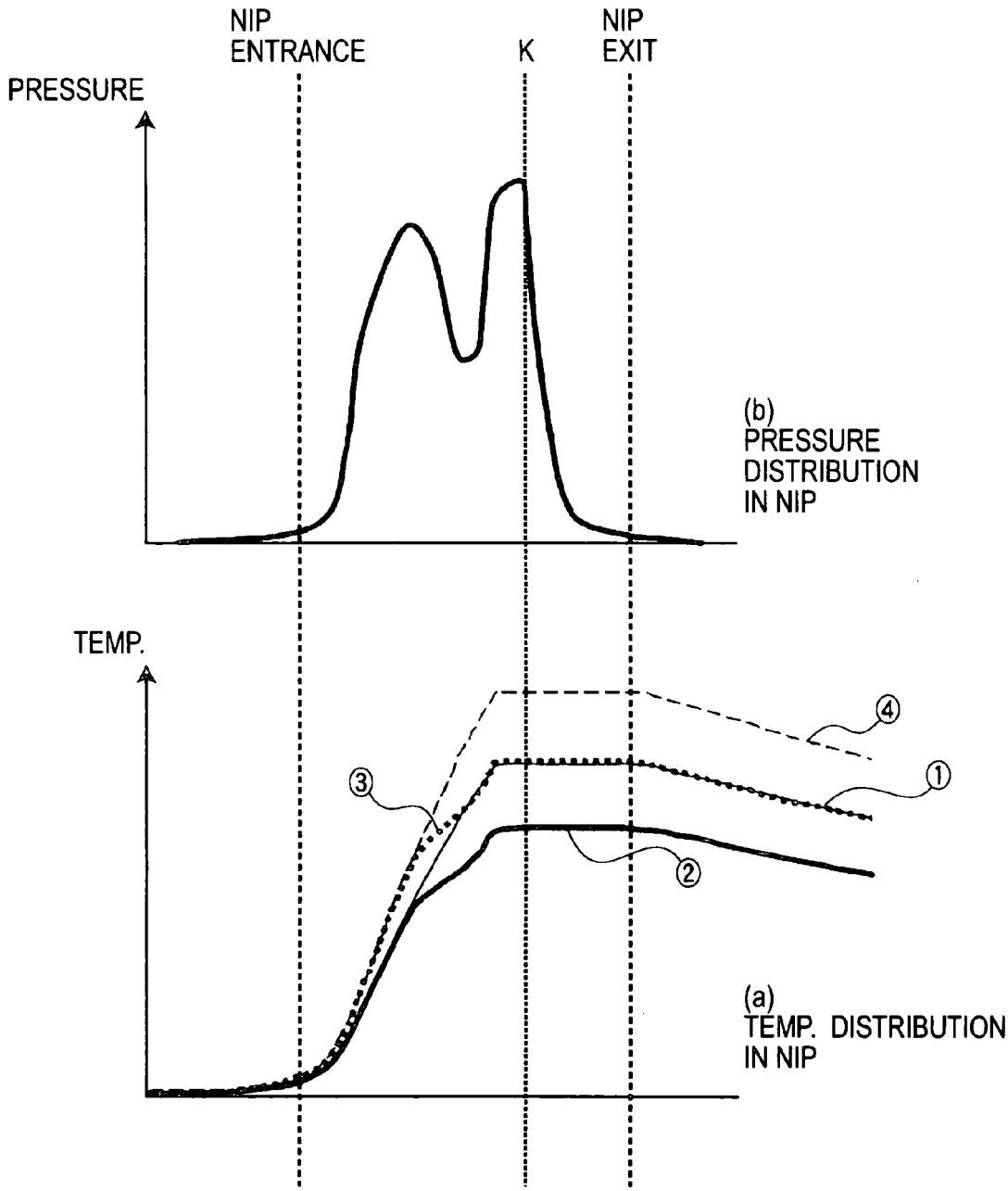
FIG. 17 is a graph showing the temperature and pressure distributions of the fixation nip of the second example of a fixing apparatus comparable to the fixing apparatus in the first embodiment.
Figure 18:
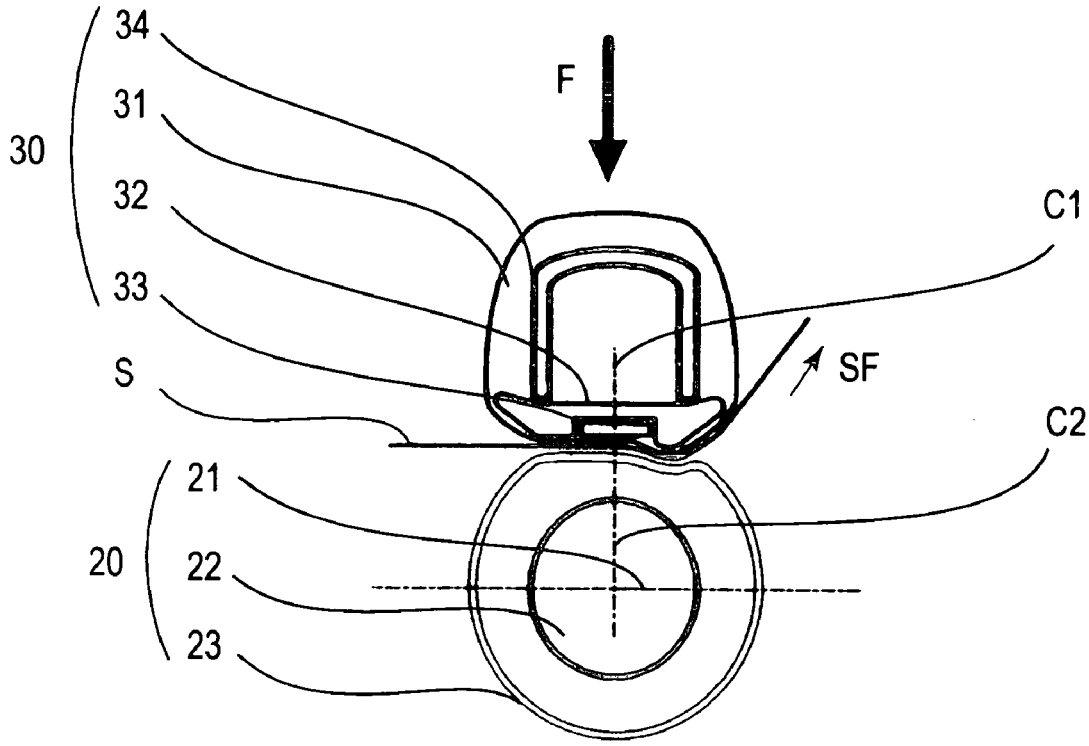
FIG. 18 is a schematic sectional view of the second example of a fixing apparatus comparable to the fixing apparatus in the first embodiment, showing the structure thereof.

Next, referring to FIG. 17, the relationship between the state of contact between the fixation film and the combination of the recording medium S and the toner thereon, and the temperature distribution and pressure distribution in the fixation nip N, will be described. The pressure distribution in the fixation nip N of this second example of a fixing apparatus is as shown in FIG. 17(*b*). That is, there is an area, in the fixation nip N, in which the internal pressure is lower than the internal pressure of the immediately preceding area in terms of the recording medium conveyance direction. Therefore, as the recording medium S is conveyed through the fixation nip N, the contact between the fixation film and the toner on the recording medium S becomes nonuniform in terms of the lengthwise direction of the fixation nip N. In terms of the recording medium conveyance direction, the temperature distribution of the fixation nip N, corresponding to the portion of the fixation nip N, in terms of its lengthwise direction, in which the contact is satisfactory (the fixation film and the toner on the recording medium are perfectly in contact with each other) in the aforementioned low pressure area, is as represented by Line 1 in FIG. 17(*a*). That is, the internal temperature of the fixation nip N reaches the optimal level at a point on the upstream side of the point K at which the internal pressure of the fixation nip N is highest, allowing thereby the fixation nip N to satisfactorily squeeze the pockets of air out of the toner at the point K. In comparison, the temperature distribution of the fixation nip N, corresponding to the portion of the fixation nip N, in terms of its lengthwise direction, in which the contact is unsatisfactory (the fixation film and the toner on the recording medium are imperfectly in contact with each other) in the aforementioned low pressure area, is as represented by Line 2 in FIG. 17(*a*). That is, the rate of the upward change in the temperature distribution begins to reduce at the point at which pressure drop begins. Therefore, the internal temperature of the fixation nip N does not reach the optimal level on the upstream side of the point K, preventing thereby the pockets of air from being efficiently squeezed out of the toner. Obviously, even the internal temperature of the portion of the fixation nip N, in which the state of the contact is unsatisfactory as represented by Line 3 in FIG. 17(*a*), can be increased to the optimal level by increasing the amount by which the heating member 33 generates heat. However, such a remedy causes the temperature of the portion of the fixation nip N, in which the state of contact is satisfactory, to become too high as indicated by Line 4 in FIG. 17(*a*), making the toner too low in elasticity. As a result, hot offset occurs. In other words, if a fixing apparatus is structured as is this second example of a fixing apparatus comparable to that in the first embodiment, in which an area, in which the internal pressure of the fixation nip N is lower than the immediately upstream side thereof is created in the fixation nip N, no latitude is afforded in achieving a desired level of surface uniformity; in other words, it is impossible to realize the effects of the present invention. Therefore, the distance by which the downstream side of the heating member holder in terms of the recording medium conveyance direction is made to protrude toward the pressure roller beyond the outwardly facing slippery surface of the downstream side of the heating member is desired to be no more than 100 μm.

Incidentally, even if this example of a fixing apparatus comparable to the fixing apparatus in the first embodiment is modified in structure in order to change the position of the contact area (fixation nip N: fixation pressure generation area) between the heating unit and pressure roller in terms of the horizontal direction, more specifically, in order to cause the line C1 which is perpendicular to the recording medium pressing flat portion of the fixation film guiding surface made up of the outwardly facing slippery surfaces of the heating member 33 and heating member holder 32, and coincides with the center thereof in terms of the recording medium conveyance direction, to coincide with the rotational axis of the pressure roller 20, the area, the internal pressure of which is lower than that in the immediately preceding area in terms of the recording medium conveyance direction, remains in the fixation nip N, and therefore, the effects of the present invention cannot be realized.

Embodiment 2

Figure 19A:
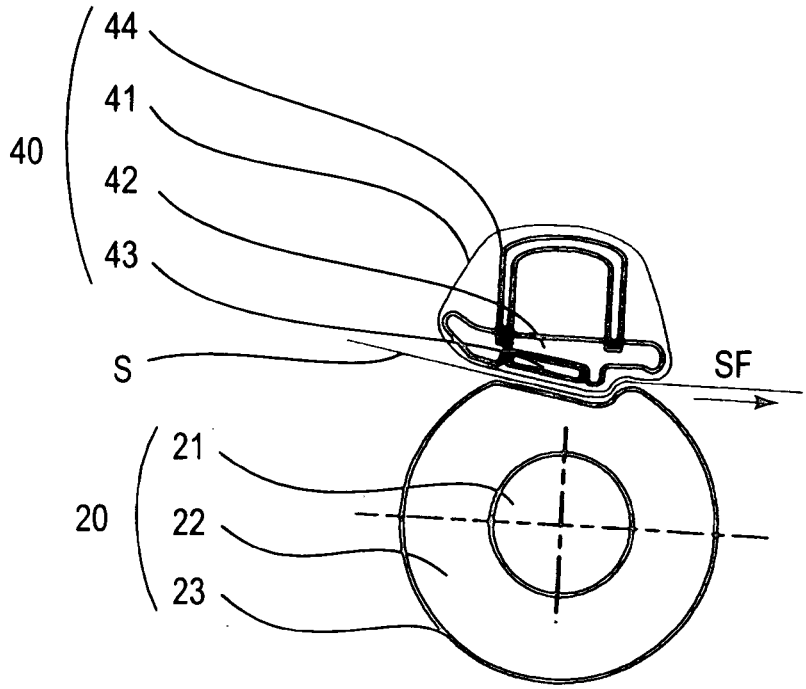
FIG. 19(*a*) is a schematic sectional view of the fixing apparatus in the second embodiment of the present invention, showing the structure thereof (No. 1).
Figure 19B:
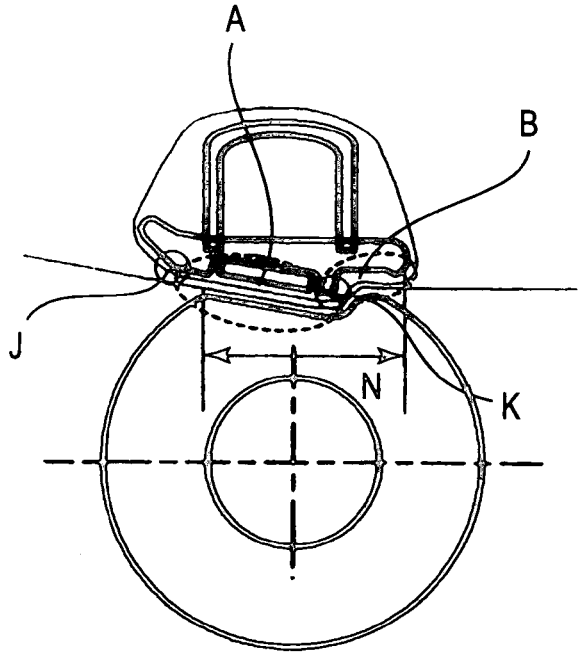
Figure 19C:
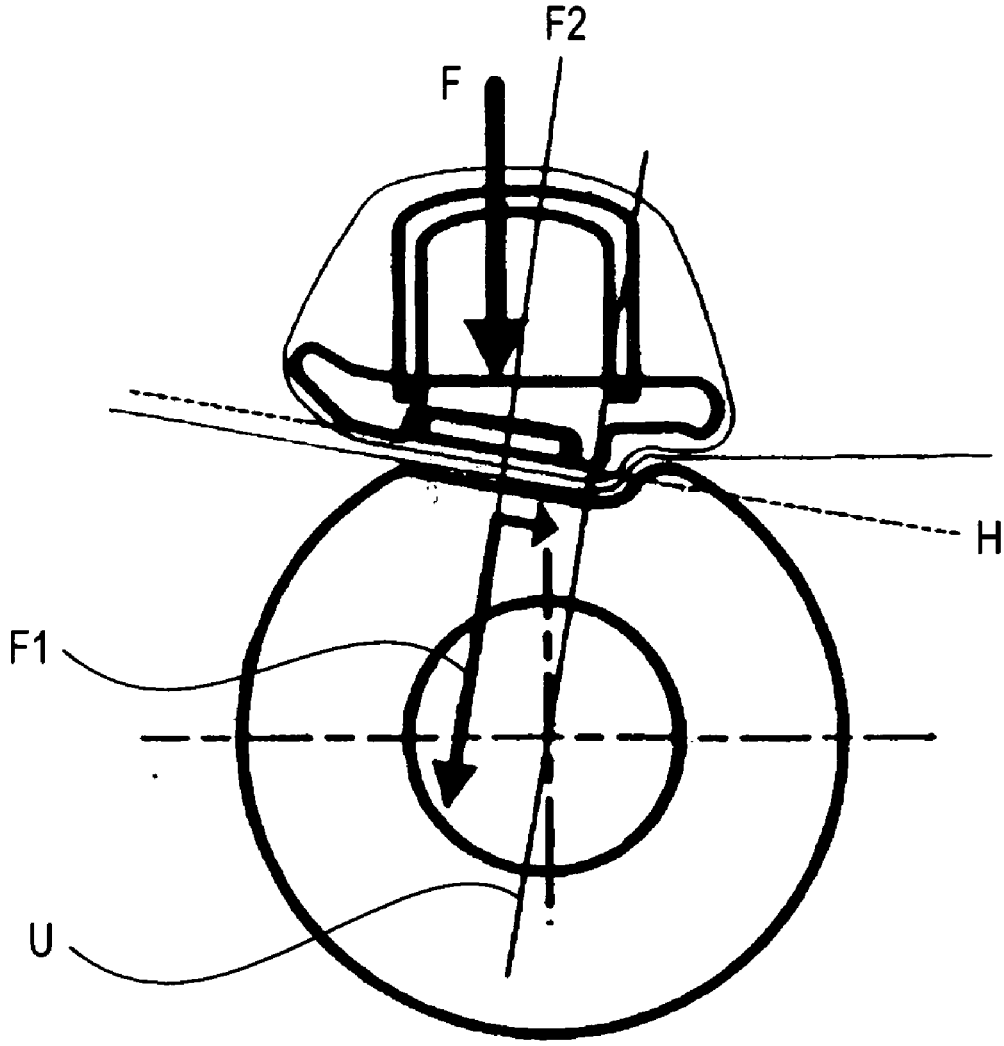

FIGS. 19(*a*)–19(*b*) are schematic sectional views of the essential portion of the fixing apparatus in this embodiment. The structural members and portions of the fixing apparatus in this embodiment identical to those in the first embodiment will be given the same referential symbols as those in the first embodiment, and will not be described here.

Essentially, the fixing apparatus 10 in this embodiment comprises a pressure roller 20 and a heating unit 40. The pressure roller 20 is 20 mm in diameter, and is provided with an elastic layer, the hardness of which is 60° in Asker-C hardness scale. The heating unit 40 is kept pressed against the pressure roller 20, forming a fixation nip N, and is provided with a heating means for heating the fixation nip N.

The pressure roller 20 comprises a metallic core 21 formed of aluminum or iron, an elastic layer 22 fitted around the metallic core 21, and a mold release layer 23 coated on the peripheral surface of the elastic layer 22.

The elastic layer 22 is a solid rubber layer formed of silicon rubber or the like, a sponge rubber layer formed of foamed silicon rubber made by foaming the silicon rubber in order to make the silicon rubber thermally insulative, a foamed rubber layer formed of foamed silicon rubber made by dispersing hollow filler particles in the silicon rubber to make the silicon rubber thermally insulative, or the like.

The mold release layer 23 may be formed by coating the peripheral surface of the elastic layer 22 with fluorinated resin, such as perfluoroalkoxyl resin (PFA), polytetrafluoroethylene resin (PTFE), and tetrafluoroethylene-hexafluoropropylene resin (FEP), or GLS latex. It may be a tube fitted over the elastic layer 22. It may be formed by coating the peripheral surface of the elastic layer 22 with mold releasing paint.

The heating unit 40 comprises: a heat resistant cylindrical fixation film 41 which is 18 mm in diameter and 64 μm in thickness; a heating member holder 42 for cylindrically holding the fixation film 41; and a rigid metallic pressure application stay 44 for holding the heating member holder 42. The fixation film 44 is loosely fitted around the combination of the heating member holder 42 and stay 44. The heating unit 40 also comprises a heating member 43 in the form of a piece of plate (which hereinafter may be referred to as heating plate), which is 5.83 mm in width, and is held to the heating member holder 42, extending in the lengthwise direction of the holder 42. The heating unit 40 is kept pressed against the pressure roller 20 by an unshown pressing means, which generates pressure F (=20 kgf), with the fixation film 41 sandwiched between the heating plate 43 and pressure roller 20, forming thereby a fixation nip N shown in FIG. 19(*b*). Referring to FIG. 19(*c*), the plane of which is perpendicular to the rotational axis of the pressure roller 20, the heating unit 40 is kept pressured toward the rotational axis of the pressure roller 20 by the force F. The direction U of the normal line to the flat portion of the recording medium pressing surface of the heating member holder 42 is not parallel to the direction in which the force F is applied to the heating unit 40 to keep the heating unit 40 pressed against the pressure roller 20. In other words, the flat portion of the recording medium pressing slippery surface of the heating unit 40 made up of the outwardly facing surfaces of the heating plate 43 and heating member holder 42, forms an angle of 4.4° relative to the horizontal plane, making the amount of the invasion by the flat portion into the pressure roller 20 relative to the peripheral surface of the pressure roller 20, gradually increase toward the downstream end of the flat portion in terms of the recording medium conveyance direction. Incidentally, the direction in which force is applied to the heating member holder 43 is desired to be set so that the angle at which force is applied to the heating member holder 43, relative to the direction of the normal line to the outwardly facing slippery surface of the heating member 43 (hypothetical line perpendicular to the outwardly facing surface of heating member 43) falls in the range of 0–30°. With the employment of such a structural arrangement, the upstream end J of the flat portion of the recording medium pressing portion of the fixation film pressing surface of the heating unit 40 is placed outside the recording medium entrance of the fixation nip N, and the downstream end K thereof is placed in the fixation nip N. In this second embodiment, the portion A, that is, the portion between the recording medium entrance of the fixation nip N and the downstream end K of the aforementioned flat portion, is 7.7 mm, and the distance by which the downstream end K of the flat portion invades into the pressure roller 20 is 1.09 mm. Also in this embodiment, the hypothetical line which is perpendicular to the fixation film contacting surface of the heating member, and coincides with the center thereof, is on the upstream side of the vertical plane coinciding with the rotational axis of the pressure roller 20.

The heating unit 40 is kept pressed against the pressure roller 20 with the interposition of the fixation film 44. The fixation film 44 held pinched between the heating member 42 and heating plate 43 is circularly rotated around the combination of the heating member holder 42 and rigid pressure application stay 44 by the rotation of the pressure roller 20.

The portion of the heating member holder 42, on the downstream side of the downstream end K of the portion A, is made to curve inward of the heating unit 40, forming the second portion B of the recording medium pressing slippery surface of the heating unit 40, which extends from the downstream end K to the recording medium exit of the fixation nip N, and is 3 mm in width in terms of the recording medium conveyance direction.

The fixation film 41 is a resin film comprising a substrate layer formed of heat resistant and heat insulating film of resin, such as polyamide, polyamide-imide, PEEK, PES, PPS, PFA, PTFE, FEP, etc., and a surface layer formed of a single or mixture of heat resistant resins, such as PFA, PTFE, FEP, silicone resin, etc., superior in mold releasing properties.

The heating member holder 42 is formed of resin such as liquid polymer, phenol resin, PPS, PEEK, etc., which are heat resistant and slippery.

The heating plate 43, that is, a heating member in the form of a piece of flat plate, is controlled in such a manner that the surface temperature of the pressure roller 20 or temperature of the inward surface of the heating plate 43 is maintained at a target temperature based on such information as the temperature detected by an unshown temperature detecting means, such as a thermistor, placed at an optional location next to the inward surface of the portion of the fixation film 44, within the range of the fixation nip N.

As described above, in this embodiment, the direction U of the normal line to the flat portion of the recording medium pressing portion of the fixation film pressing slippery surface of the heating unit 40 made up of the outwardly facing surfaces of the heating plate 43 and heating member holder 42 is not parallel to the direction in which the force F is applied to keep the heating unit 40 pressed against the pressure roller 20. Therefore, the recording medium pressing flat portion is angled relative to the horizontal plane (FIG. 19(*c*). Further, the upstream end J of the flat portion is outside the fixation nip N, and the downstream end K of the flat portion is in the fixation nip N (FIG. 19(*b*)). Therefore, the distribution of the internal pressure of the fixation nip N is such that the internal pressure gradually increases toward the point K, at which the internal pressure is highest in the fixation nip N. Therefore, as the recording medium S is conveyed through the fixation nip N, not only is it continuously heated by the heating plate 43, but also, the pressure which applies to the recording medium S gradually increases with virtually no decrease until the recording medium S reaches the point K. Further, the heating member is located on the upstream side of the point K of the heating member holder 42, at which the internal pressure of the fixation nip N is highest. Therefore, the portion of the fixation nip N, which includes the portion A, and in which the combination of the recording medium S and the unfixed toner image is continuously heated without any drop in temperature, and in which the pressure which applies to the combination continuously and gradually increases, can be separated from the portion of the fixation nip N at which the internal pressure of the fixation nip N is highest. The pressure distribution of the fixation nip N of the fixing apparatus in this embodiment is the same as that of the fixing apparatus in the first embodiment, which is represented by Line 1 in FIG. 5(*a*), and the temperature distribution thereof is the same as that of the fixing apparatus in the first embodiment, shown in FIG. 5(*b*). Therefore, before the toner reaches the point K (downstream end K of flat portion A), at which the internal pressure of the fixation nip N is highest, the toner is thoroughly melted, allowing the pockets of air to be efficiently squeezed out of the toner. Further, the toner is not unnecessarily heated after it is moved past the point K; the temperature of the portion of the fixation nip N, on the downstream side of the point K remains at the target temperature level. Therefore, it is possible to achieve the desired level of uniformity in surface properties, in particular, glossiness, and more latitude is afforded in controlling the fixation temperature in order to prevent hot offset.

In addition, the direction U of the normal line to the flat portion A of the fixation film pressing slippery surface made up of the outwardly facing surfaces of the heating plate 43 and heating member holder 42 is not parallel to the direction F in which the heating unit 40 is kept pressured toward the pressure roller. Therefore, the flat portion A is tilted relative to the horizontal plane tangential to the peripheral surface of the pressure roller 20. Therefore, not only is the force F1, the direction of which is perpendicular to the flat portion A, generated, but also, the force F2, the direction of which is parallel to the flat portion A and the direction SF in which the recording medium S is conveyed, while sandwiched between the fixation film and pressure roller, is generated, raising the level of stability at which the recording medium S is conveyed through the fixation nip N. Therefore, the possibility that the amount of the pressure applied to the recording medium S by the recording medium pressing slippery surfaces of the heating plate 43 and heating member holder 42, through the fixation film 41, locally reduces within the fixation nip N, is reduced, enabling thereby the fixation nip N to reliably squeeze the pockets of air. Therefore, it is possible to further raise the level of uniformity in surface properties, in particular, glossiness.

Also in this embodiment, the heating plate 43 and heating member holder 42 which make up the fixation film pressing slippery surfaces of the heating unit 40 are rigid members, as those in the first embodiment, making it easier to control the pressure F.

Further, the fixing apparatus in this embodiment is provided with the portion B as is the fixing apparatus in the first embodiment. Therefore, it is possible to raise the level of glossiness without the occurrence of hot offset, as it can be done in the first embodiment. Further, the provision of the portion B prevents the recording medium S from remaining curled. Therefore, the recording medium S is smoothly separated from the fixation film 41 at the recording medium exit of the fixation nip N; it is prevented from remaining wrapped around the fixation film 41.

The shapes and materials of the members of the fixing apparatus in this embodiment, and the values representing the properties thereof, are not mandatory. As long as they can realize the pressure and temperature distributions shown in FIG. 5 (Line 1 in FIG. 5(*a*), and FIG. 5(*b*), respectively), they do not adversely affect the effects of the present invention.

Embodiment 3

Figure 20:
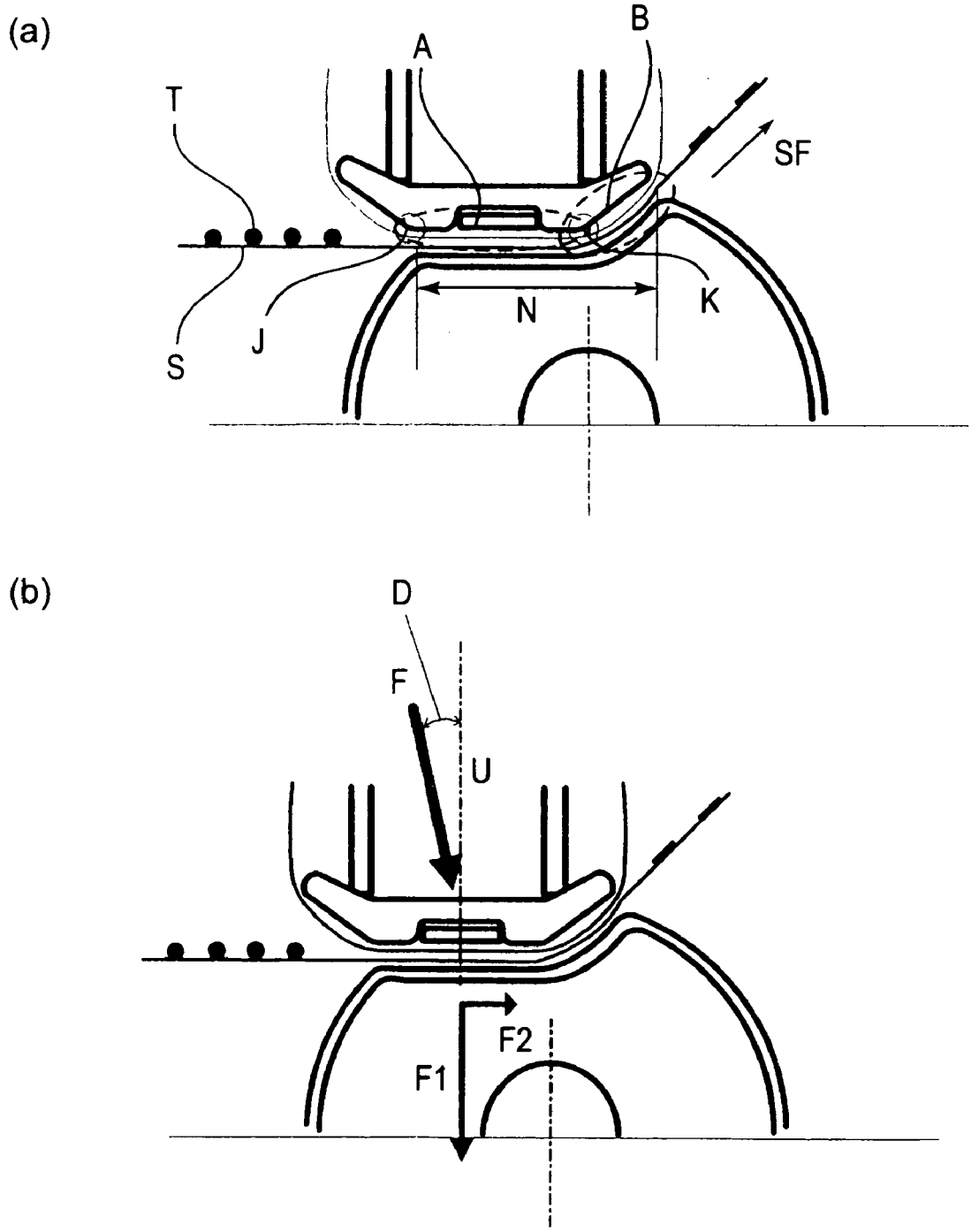
FIG. 20 (20(*a*) and 20(*b*)) is a schematic sectional view of the fixing apparatus in the third embodiment of the present invention, showing the structure thereof.
Figure 21:
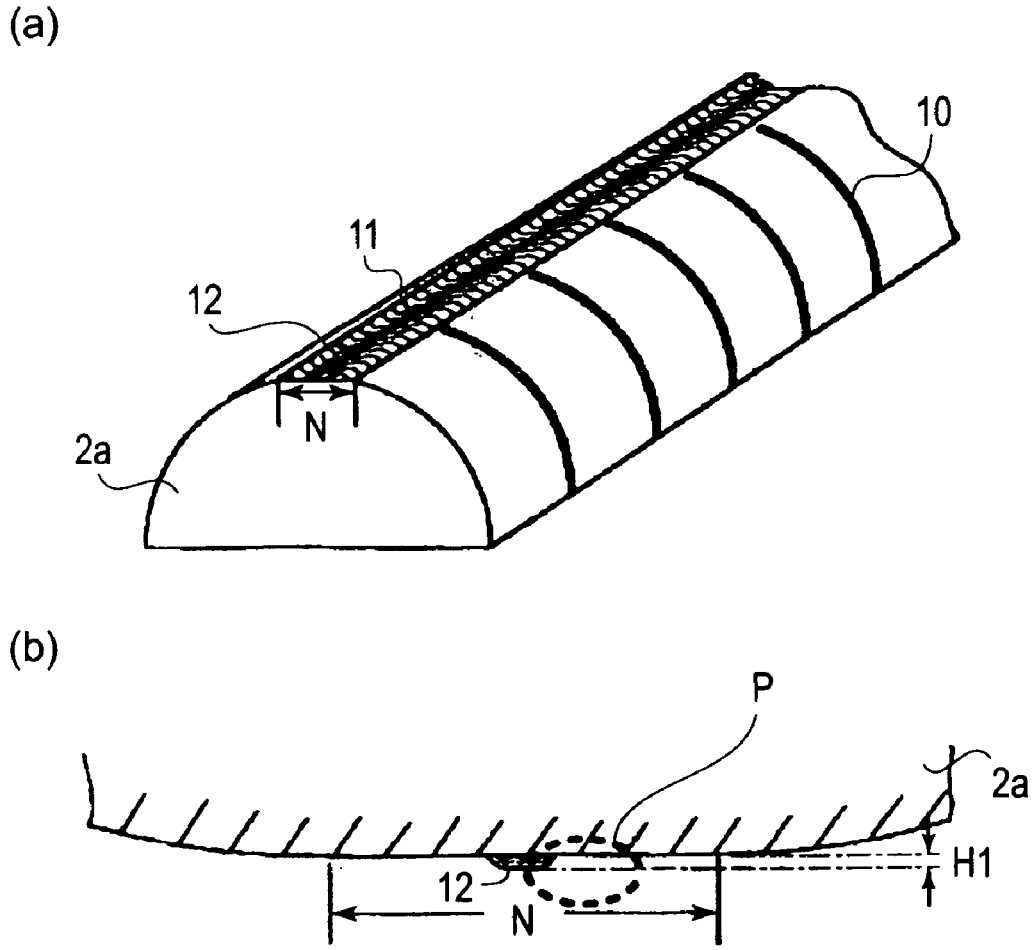
FIG. 21 (21(*a*) and 21(*b*)) is a schematic drawing of a thermal fixing apparatus in accordance with the prior art, showing the structure thereof.
Figure 22:
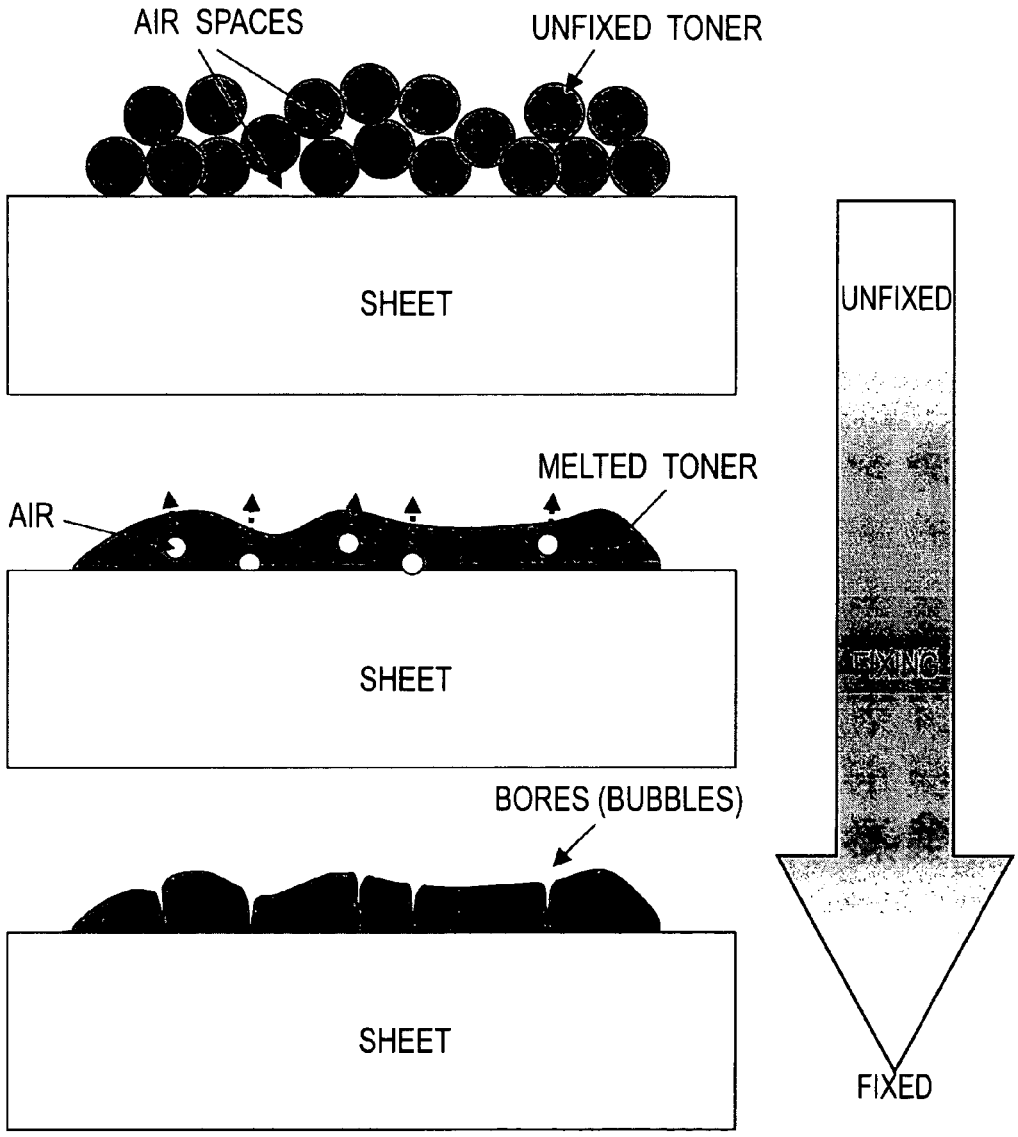
FIG. 22 is a schematic drawing showing the changes which occur to a given portion of the toner layer as the given portion is moved through the fixation nip insufficient in the amount of the pressure which applies to the toner image (layer) during fixation.
Figure 23:
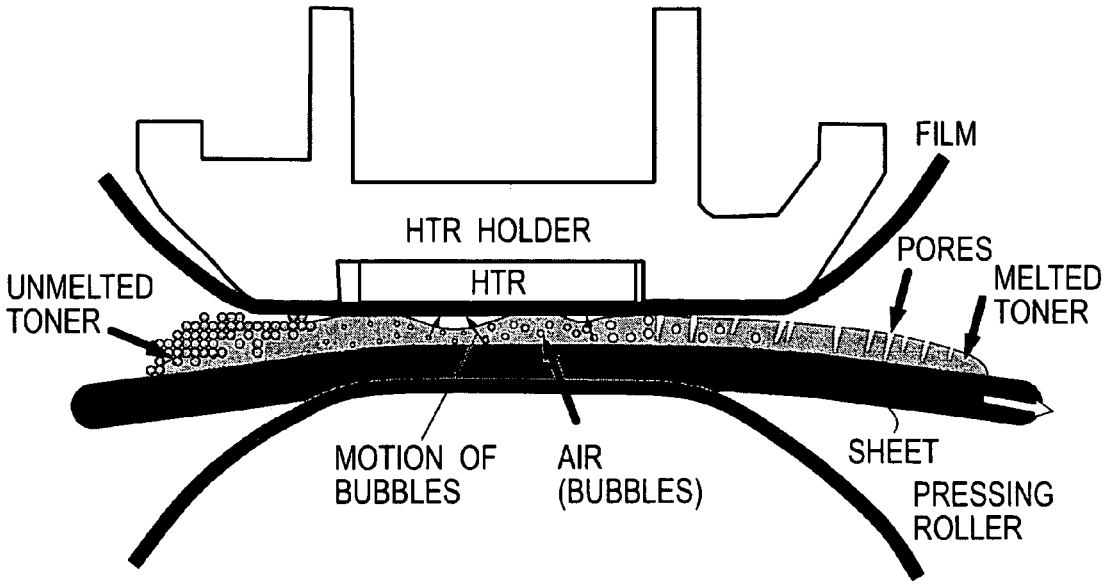
FIG. 23 is a schematic drawing showing the changes in the state of fixation which occur at a given portion of the toner layer as the given portion is moved through the fixation nip insufficient in the amount of the pressure which applies to the toner image (layer) during fixation.

FIG. 20 is a schematic sectional view of the essential portion of the fixing apparatus in this embodiment. The structural members and portions of the fixing apparatus in this embodiment identical to those in the first embodiment will be given the same referential symbols as those in the first embodiment, and will not be described here. The difference between this embodiment and the second embodiment is that in the second embodiment, the surface which catches the force F from the heating member holder 42 is roughly perpendicular to the direction of the force F (surface which catches force F of heating member holder is nonparallel to outwardly facing slippery surface of heating member 43), whereas in this embodiment, the surface which catches the force F of the heating member holder 42 is not perpendicular to the direction of the force F (surface which catches force F from heating member holder 42 is roughly parallel to the outwardly facing slippery surface of the heating member holder 42).

Referring to FIG. 20, the plane of which is perpendicular to the rotational axis of the fixation film of the heating unit 30, in the case of the fixing apparatus in this embodiment, the direction parallel to the direction of the force F, in which the heating unit 30 is kept pressured toward the pressure roller 20 (direction in which pressure is applied on heating member holder 42), is tilted upstream in terms of the recording medium conveyance direction SF, that is, tilted toward the recording medium entrance of the fixation nip N, at an angle D, which is no more than 30°, relative to the direction U of the normal line to the flat portion of the recording medium pressing surface of the heating member holder 42, in the range of the fixation nip N. In other words, $0° < D \leqq 30°$.

The pressure and temperature distributions similar to those shown in FIG. 5 (Line 1 in FIG. 5(*a*), and FIG. 5(*b*), respectively), which are realized in the first embodiment, can also be realized by the employment of the above described structural arrangement for a fixing apparatus in this embodiment. Therefore, the effects realized by the first embodiment, that is, improvement in the level of uniformity in surface properties, in particular, glossiness, achieved by the flat slippery portion A, more latitude in prevention of hot offset, uncurling of the recording medium S by the slippery portion B, and prevention, by the slippery portion B, of the wrapping of the recording medium around the fixation film, can be realized also by the structural arrangement in this embodiment.

In the case of the above described structural arrangement in this embodiment, the direction of the force F is tilted upstream, at an angle D. Therefore, not only the force F1, the direction of which is perpendicular to the slippery surface, is generated, but also, the force F2, the direction of which is parallel to the slippery surface, and the direction SF in which the recording medium S is conveyed, being sandwiched between the fixation film and pressure roller, is generated, raising thereby the level of stability at which the recording medium S is conveyed through the fixation nip N. Therefore, the possibility that the amount of the pressure applied to the recording medium S by the recording medium pressing slippery surfaces of the heating plate 43 and heating member holder 42, through the fixation film 41, locally reduces within the fixation nip N, is reduced, enabling thereby the fixation nip N to reliably squeeze the pockets of air. Therefore, it is possible to further raise the level of uniformity in surface properties, in particular, glossiness, at which a toner image is fixed.

If the angle D is no less than 30°, the force F, the direction of which is perpendicular to the slippery surface, generates an excessive amount of force F2, which acts on the recording medium S in the direction to convey the recording medium S, raising the level of stability at which the recording medium S is conveyed. However, the pressure for keeping the fixation film satisfactorily in contact with the toner image on the recording medium S reduces or becomes unstable. Therefore, the pockets of air cannot be efficiently squeezed out, lowering the level of the uniformity in surface properties at which the toner image is fixed. This is why the angle D of the force F is to be set to a value in the aforementioned range. With the angle D set to a value within the aforementioned range, the pockets of air can be more reliably squeezed out to raise the level of uniformity in surface properties, in particular, glossiness, at which the unfixed toner image is fixed by the fixing apparatus. Regarding the value to which the angle D between the direction of the force F relative to the direction U of the normal line to the slippery surface, it should be selected in accordance with the coefficient of the friction between the recording medium S and slippery surface, or the like factors. However, it should be set to a value no more than 30°, because as long as it is set to a value no more than 30°, the effects of the present invention are satisfactorily realized. By structuring a fixing apparatus as the fixing apparatus in this embodiment is structured so that the direction in which the force F is applied to keep the heating unit pressured toward the pressure roller is tilted at the angle D, relative to the normal line U to the slippery surface, not only is the effects realized by the first embodiment, but also, the effects realized by the second embodiment can be realized.

Embodiment 4

This embodiment is characterized in that the portion the heating member holder (32 and 42 in Embodiments 1–3), which remains in contact with the inward surface of the fixation film (32 and 42 in Embodiments 1–3) as the fixing film is circularly rotated around the heating member holder, sliding thereon, or the entirety of the heating member holder, is formed of PTFE, or a substance comparable in heat resistance and slipperiness.

Forming the portion of the heating member holder (32 and 42), which remains in contact with the inward surface of the fixation film (32 and 42) as the fixation film is circularly rotated around the heating member holder, sliding thereon, or the entirety of the heating member holder, of a substance such as PTFE which is heat resistant as well as slippery, improves the level of stability at which the fixation film is circularly moved around the heating member holder, and also, the durability of the fixation film. Therefore, a fixing apparatus is improved in the state of contact between the heating member holder and fixation film, and the state of contact between the heating plate (33 in Embodiment 1–3) and fixation film, not only making it possible to more reliably fix an unfixed toner image, but also, raising the level of uniformity in surface properties, in particular, glossiness, at which the unfixed toner image is fixed.

Embodiment 5

This embodiment is characterized in that the portion the heating member holder (32 and 42 in Embodiments 1–3), which remains in contact with the inward surface of the fixation film (32 and 42 in Embodiments 1–3), in the fixation nip N, as the fixing film is circularly rotated around the heating member holder, sliding thereon, or the entirety of the heating member holder, is coated with fluorinated substance which is heat resistant and slippery.

Forming the portion of the heating member holder (32 and 42), which remains in contact with the inward surface of the fixation film (32 and 42) as the fixation film is circularly rotated around the heating member holder, sliding thereon, or the entirety of the heating member holder, of a substance such as PTFE, or the like, mentioned in the fourth embodiment, which is heat resistant as well as slippery, raises the level of stability at which the fixation film is circularly moved around the heating member holder, and also, the durability of the fixation film. Therefore, a fixing apparatus is improved in the state of contact between the heating member holder and fixation film, and the state of contact, in the fixation nip N, between the heating plate (33 in Embodiments 1–3) and fixation film, not only making it possible to more reliably fix an unfixed toner image, but also, raising the level of uniformity in surface properties, in particular, glossiness, at which the unfixed toner image is fixed.

(Miscellanies)

1) A fixing apparatus in accordance with the present invention includes such an image heating apparatus as an image fixing apparatus for temporarily fixing an unfixed image to recording medium, a surface property improving apparatus for reheating a recording medium bearing a fixed image to improve the image in surface properties such as glossiness, or the like heating apparatus.

2) In the preceding embodiments of the present invention, a ceramic heater structured as shown in FIG. 3 is employed as the heating member. Obviously, a ceramic heater employed as the heating member may have a structure different from the one shown in FIG. 3. For example, it may be a ceramic heater of the so-called rear surface heating type, in which the heat generating resistive layer 33*b* is placed on the opposite surface of the substrate 33*a* from the surface on which the flexible member slides. Further, it may be a heating device employing a piece of Nichrome wire, or the like, or a heat generating device comprising a piece of iron plate or the like, in which heat can generated by electromagnetically induced current.

3) In the preceding embodiments, a thermistor of a contact type is employed as a means for detecting the temperature of the heating member. However, the temperature detecting means may be of a noncontact type, which detects radiant heat, and the employment of such a temperature detecting means causes no problem at all. Further, the location of the temperature detecting means does not need to be limited to those in the preceding embodiments; the temperature control is possible even if the temperature detecting means is disposed at a location different from those in the preceding embodiments.

4) The material for the flexible member does not need to be limited to the film of heat resistant resin. It may be metallic film, or composite film.

5) In the preceding embodiments, the flexible member is a cylindrical member (flexible sleeve), and is rotated by the rotation of the pressure roller driven by a driving means. However, the means for rotating the flexible member is optional. For example, a driver roller may be placed within the loop of the endless film (flexible member) to rotationally drive the endless film by rotationally driving the driver roller.

6) The flexible member may be in the form of a roll of a long piece of web, which is rolled out and moved in contact with the heating member.

As described above in detail, according to the present invention, the pressure and temperature distributions in the fixation nip can be optimized. Therefore, an image which is highly glossy and does not suffer from the defects attributable to nonuniform heating can be outputted, without sacrificing the benefits of a fixing apparatus of a film heating type, that is, thermal efficiency, rapid startup, low cost, etc.

While the invention has been described with reference to the structures disclosed herein, it is not confined to the details set forth, and this application is intended to cover such modifications or changes as may come within the purposes of the improvements or the scope of the following claims.

This application claims Priority from Japanese Patent Applications No. 195772/2003 filed Jul. 11, 2003 and No. 193164/2004 filed Jun. 30, 2004, which is hereby incorporated by reference.

What is claimed is:

1. An image heating apparatus for heating an image formed on a recording material, comprising;

a heating member;

a holder for holding said heating member;

a flexible member movable in contact with said heating member;

an elastic roller for forming a nip portion with said heating member and with said holder, with said flexible member interposed therebetween;

wherein a pressure in the nip portion increases downstream with respect to a moving direction of the recording material without decreasing from an entrance of the nip to a maximum peak portion of the pressure, and decreases from the maximum peak portion to the exit of the nip, wherein said heating member is disposed upstream of the maximum peak portion with respect to the moving direction of the recording material, and wherein in a pressure decreasing region from the maximum peak portion to the exit of the nip, said heating member and said flexible member do not contact each other, and the nip portion is formed by said holder and said elastic roller.

2. An apparatus according to claim 1, wherein the maximum peak portion is provided by said holder for holding said heating member.

3. An apparatus according to claim 1, wherein the maximum peak portion is provided at a downstream end of said heating member with respect to the moving direction.

4. An apparatus according to claim 1, wherein said heating member has a heat generating resistor and a flat substrate supporting said heat generating resistor, and said substrate and said elastic roller are positioned such that normal line at a center portion of a flat surface contacted to said flexible member of said substrate with respect to the moving direction is at an upstream side of a center of rotation of said elastic roller with respect to the moving direction.

5. An apparatus according to claim 1, wherein said heating member has a heat generating resistor and a flat substrate supporting said heat generating resistor, and a downstream end of said substrate with respect to the moving direction is inclined more toward said elastic roller than the upstream end.

6. An apparatus according to claim 1, wherein said heating member has a heat generating resistor, a flat substrate supporting said heat generating resistor, and wherein a direction of pressure toward the holder is inclined toward upstream with respect to the feeding direction relative to a normal line to a sliding surface between said substrate and said flexible member.

7. An apparatus according to claim 6, wherein an angle D formed between the direction of pressing to the holder and the normal line to a sliding surface between said substrate and said flexible member, is $0° < D \leqq 30°$.

8. An apparatus according to claim 6, wherein a surface receiving a pressure from the holder is non-parallel relative to the sliding surface between said substrate and said flexible member.

9. An apparatus according to claim 6, wherein a surface receiving the pressure from said holder is substantially parallel with the sliding surface between said substrate and said flexible member.

10. An apparatus according to claim 1, wherein a distance L between a crossing line between a surface of said elastic roller and an extended surface H of a sliding surface of said heating member relative to said flexible member, and a plane V perpendicular to the flat surface H and passing through an axis of rotation of said elastic roller, the maximum peak portion is disposed at a position less than (⅓) L from the flat surface V toward upstream with respect to the moving direction, or is disposed at a position less than (½) L from the flat surface V toward downstream with respect to the moving direction.

11. An apparatus according to claim 1, wherein said flexible member is a rotatable member.

12. An image heating apparatus for heating an image formed on a recording material, comprising;

a heating member;

a holder for holding said heating member;

a flexible member movable in contact with said heating member;

an elastic roller for forming a nip portion with said heating member and said holder with said flexible member interposed therebetween;

wherein a downstream end of said heating member with respect to a moving direction of the recording material presses into said elastic roller more than an upstream end of said heating member, and said heating member is disposed upstream of a maximum peak portion of a pressure in the nip portion with respect to the moving direction, and wherein a distance L between a crossing line between a surface of said elastic roller and an extended surface H of a sliding surface of said heating member relative to said flexible member, and a plane V perpendicular to the flat surface H and passing through an axis of rotation of said elastic roller, the maximum peak portion is disposed at a position less than (⅓) L from the flat surface V toward upstream with respect to the moving direction, or disposed at a position less than (½) L from the flat surface V toward downstream with respect to the moving direction, and wherein in a pressure decreasing region from the maximum peak portion to the exit of the nip, said heating member and said flexible member do not contact each other, and the nip portion is formed by said holder and said elastic roller.

13. An apparatus according to claim 12, wherein the maximum peak portion is provided by said holder for holding said heating member.

14. An apparatus according to claim 12, wherein the maximum peak portion is provided at a downstream end of said heating member with respect to the moving direction.

15. An apparatus according to claim 12, wherein said heating member has a heat generating resistor and a flat substrate supporting said heat generating resistor, and said substrate and said elastic roller are positioned such that normal line at a center portion of a flat surface contacted to said flexible member of said substrate with respect to the moving direction is at an upstream side of a center of rotation of said elastic roller with respect to the moving direction.

16. An apparatus according to claim 12, wherein a pressure in the nip portion in an area downstream of the maximum peak portion with respect to the moving direction decreases gradually to a recording material exit of the nip portion.

17. An apparatus according to claim 12, wherein said heating member has a heat generating resistor, a flat substrate supporting said heat generating resistor, and wherein a direction of pressure toward the holder is inclined toward upstream with respect to the feeding direction relative to a normal line to a sliding surface between said substrate and said flexible member.

18. An apparatus according to claim 17, wherein an angle D formed between the direction of pressing to the holder and the normal line to a sliding surface between said substrate and said flexible member, is $0° < D \leqq 30°$.

19. An apparatus according to claim 17, wherein a surface receiving a pressure from the holder is non-parallel relative to the sliding surface between said substrate and said flexible member.

20. An apparatus according to claim 17, wherein a surface receiving the pressure from said holder is substantially parallel with the sliding surface between said substrate and said flexible member.

21. An apparatus according to claim 12, wherein said flexible member is a rotatable member.

* * * * *

UNITED STATES PATENT AND TRADEMARK OFFICE

CERTIFICATE OF CORRECTION

PATENT NO. : 7,206,541 B2
APPLICATION NO. : 10/886595
DATED : April 17, 2007
INVENTOR(S) : Taku Fukita et al.

It is certified that error appears in the above-identified patent and that said Letters Patent is hereby corrected as shown below:

ON THE COVER PAGE
At Item (56), Other Publications, "cited" should read --cited reference--.

COLUMN 1
Line 55, "pocket" should read --pockets--.

COLUMN 3
Line 18, "escapes form" should read --escape from--.

COLUMN 4
Line 64, "3)" should read --3).--.

COLUMN 12
Line 60, "ext" should read --exit--.

COLUMN 30
Line 41, "can" should read --can be--.

COLUMN 31
Line 21, "comprising;" should read --comprising:--.

COLUMN 32
Line 30, "comprising;" should read --comprising:--.

Signed and Sealed this

Twentieth Day of May, 2008

JON W. DUDAS
*Director of the United States Patent and Trademark Office*